US006158834A

United States Patent [19]

Kato et al.

[11] Patent Number: 6,158,834

[45] Date of Patent: Dec. 12, 2000

[54] INK-JET RECORDING APPARATUS, INK-JET RECORDING METHOD, IMAGE PROCESSING APPARATUS FOR PROCESSING IMAGE DATA, AND METHOD OF OUTPUTTING DATA FROM A HOST APPARATUS CONNECTED TO AN INK-JET RECORDING APPARATUS

[75] Inventors: Minako Kato; Shigeyasu Nagoshi; Masao Kato, all of Yokohama, Japan

[73] Assignee: Canon Kabushiki Kaisha, Tokyo, Japan

[21] Appl. No.: 09/102,561

[22] Filed: Jun. 23, 1998

[30] Foreign Application Priority Data

Jun. 26, 1997 [JP] Japan ..... 9-170279

[51] Int. Cl.[7] ..... B41J 29/38; B41J 2/21; B41J 2/17

[52] U.S. Cl. ..... 347/9; 347/37; 347/40; 347/41; 347/43; 347/96; 347/15; 358/298; 358/1.8; 358/502

[58] Field of Search ..... 347/101, 5, 9–12, 347/15, 19, 37, 40, 41, 42, 43, 44, 96, 131; 358/298, 1.8, 502

[56] References Cited

U.S. PATENT DOCUMENTS

| | | | |
|---|---|---|---|
| 4,686,538 | 8/1987 | Kouzato . | |
| 4,847,641 | 7/1989 | Tung | 347/131 |
| 5,196,942 | 3/1993 | Shiau . | |
| 5,447,811 | 9/1995 | Buhr et al. | 347/101 |
| 5,633,663 | 5/1997 | Matsubara et al. | 347/9 |
| 5,635,969 | 6/1997 | Allen | 347/96 |
| 5,661,507 | 8/1997 | Sperry | 347/9 |
| 5,677,716 | 10/1997 | Cleveland | 347/37 |
| 5,742,325 | 4/1998 | Curry et al. | 358/298 |
| 5,777,640 | 7/1998 | Shioya et al. | 347/15 |
| 5,805,178 | 9/1998 | Silverbrook | 347/15 |
| 5,812,176 | 9/1998 | Kawabe et al. | 358/298 |
| 5,831,642 | 11/1998 | Matsubara et al. | 347/9 |
| 6,007,181 | 12/1999 | Takahashi et al. | 347/41 |
| 6,012,799 | 1/2000 | Silverbrook | 347/43 |
| 6,067,405 | 5/2000 | Serra | 347/40 |

FOREIGN PATENT DOCUMENTS

| | | |
|---|---|---|
| 0 517 544 | 12/1992 | European Pat. Off. . |
| 0 726 157 | 8/1996 | European Pat. Off. . |
| 0 726 159 | 8/1996 | European Pat. Off. . |
| 0 788 885 | 8/1997 | European Pat. Off. . |
| 58-128862 | 8/1983 | Japan . |
| 8-52867 | 2/1996 | Japan . |
| 9-226154 | 9/1997 | Japan . |

*Primary Examiner*—Eugene Eickholt
*Attorney, Agent, or Firm*—Fitzpatrick, Cella, Harper & Scinto

[57] ABSTRACT

An ink-jet recording apparatus, ink-jet recording method, and an image processing apparatus are disclosed in which the durability of an image formed with an ink on a recording medium is enhanced by applying a processing liquid to inked dots without causing an excessive application of the processing liquid thereby achieving a high-quality image including no distortion. The processing liquid having the capability of improving the recorded image in terms of resistance to water is applied to all inked dots located at edges while the processing liquid is applied to every predetermined number of inked dots at the other locations, Matrix patterns consisting of a plurality of dots for each gray level are selected so that the number of inked dots located at edges is minimized thereby minimizing the number of dots to which the processing liquid is applied thus achieving an improvement in the resistance to water using the minimized amount of the processing liquid.

30 Claims, 17 Drawing Sheets

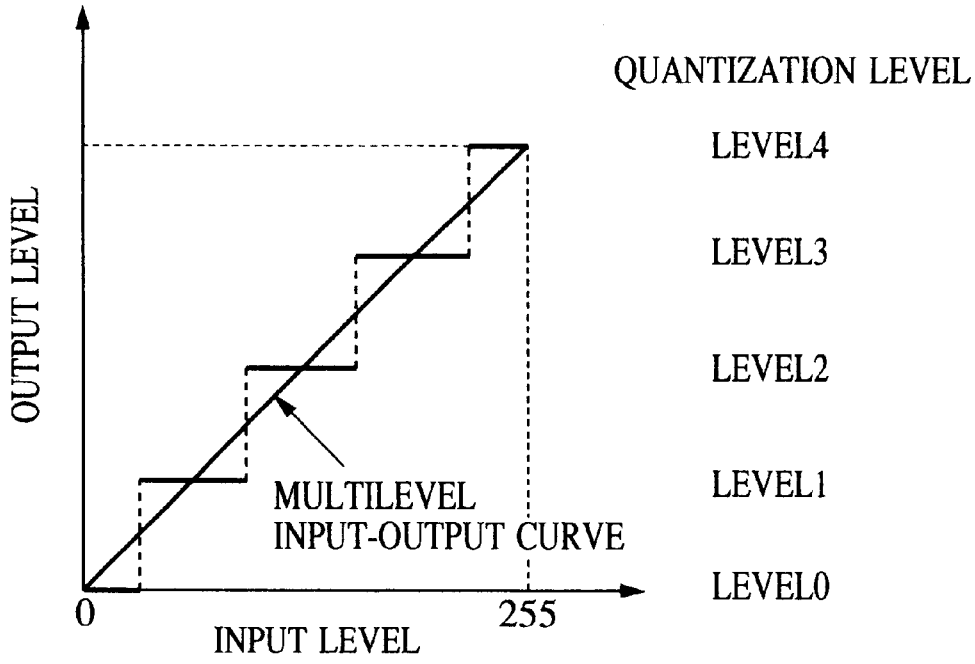
FIG. 2A
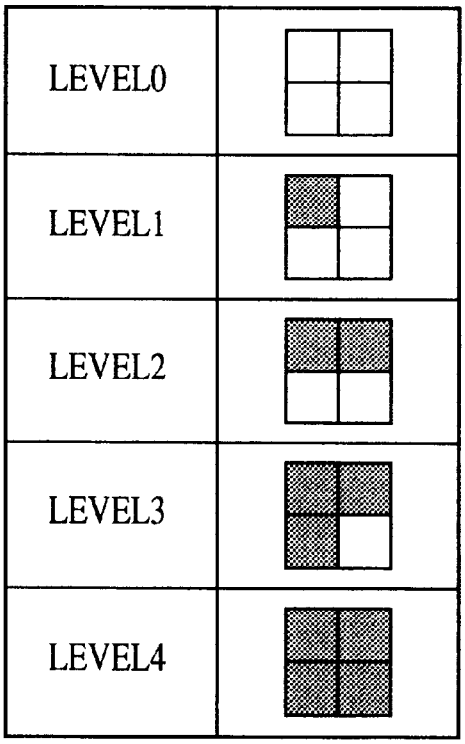
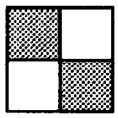
FIG. 2C
FIG. 2B

TWO LOW-DENSITY INK DOTS

ONE LOW-DENSITY INK DOT
ONE HIGH-DENSITY INK DOT

TWO HIGH-DENSITY INK DOTS

| PREVIOUS DOT PATTERN | CANDIDATES FOR THE NEXT DOT PATTERN | |
|---|---|---|
| | LEVEL | |
| p01 | 1<br>2<br>3 | ANY POSSIBLE PATTERN |
| p11 | 1 | OR |
| | 2 | |
| | 3 | OR |
| p12 | 1 | |
| | 2 | |
| | 3 | OR |
| p13 | 1 | OR |
| | 2 | |
| | 3 | OR |
| p14 | 1 | |
| | 2 | |
| | 3 | OR |
| p21 | 1 | |
| | 2 | |
| | 3 | OR |
| p22 | 1 | |
| | 2 | |
| | 3 | OR |

| PREVIOUS DOT PATTERN | CANDIDATES FOR THE NEXT DOT PATTERN | |
|---|---|---|
| | LEVEL | |
| p31 | 1 | |
| | 2 | |
| | 3 | OR |
| p32 | 1 | |
| | 2 | |
| | 3 | OR |
| p33 | 1 | OR |
| | 2 | ANY POSSIBLE PATTERN |
| | 3 | ANY POSSIBLE PATTERN |
| p34 | 1 | OR |
| | 2 | ANY POSSIBLE PATTERN |
| | 3 | ANY POSSIBLE PATTERN |
| p41 | 1 | OR |
| | 2 | ANY POSSIBLE PATTERN |
| | 3 | ANY POSSIBLE PATTERN |

FIG. 17

INK-JET RECORDING APPARATUS, INK-JET RECORDING METHOD, IMAGE PROCESSING APPARATUS FOR PROCESSING IMAGE DATA, AND METHOD OF OUTPUTTING DATA FROM A HOST APPARATUS CONNECTED TO AN INK-JET RECORDING APPARATUS

BACKGROUND OF THE INVENTION

1. Field of the Invention

The present invention relates to an ink-jet recording apparatus for recording by emitting ink, an ink-jet recording method, an image processing apparatus for processing an image to be recorded, and a method of outputting data from a host device connected to an ink-jet recording apparatus.

More particularly, the present invention relates to an ink-jet recording apparatus, an ink-jet recording method, and an image processing apparatus based on the technique of recording by quantizing data to three or more levels and then mapping the quantized data to L×M matrices.

2. Description of the Related Art

Various color recording techniques are known in the art. They include a thermal transfer recording technique in which recording is performed by transferring ink from an ink ribbon by means of thermal energy, and an ink-jet recording technique in which recording is performed by firing an ink droplet to a recording medium such as paper.

Of these various techniques, the ink-jet recording technique has the advantages of low noise, low running cost, small size, and the capability of easily forming a color image. In view of these advantages, the ink-jet recording technique is used in a wide variety of applications such as a printer, copying machine, etc.

The recent trend in the technology of the ink-jet recording apparatus is that recording liquid droplets with a smaller size are employed to achieve a higher resolution thereby achieving high quality in recorded images.

However, as the resolution becomes high, the data to be processed becomes exceedingly large. As a result, a longer time is required for a host computer to process the data and transfer the resultant data to a recording apparatus. This causes great reduction in the total throughput of the system.

One known technique to solve the above problem is to employ a matrix pattern in the recording process. In this technique, a host computer processes data with a relative low resolution and a rather large number of quantization levels and outputs the resultant data to a printer which in turn converts the received data into a matrix form and. performs recording in accordance with the matrix data. For example, a host computer quantizes image data to 5-level (3-bit) data with a resolution of 300×300 dpi, and the printer converts the data received from the computer to bilevel data with a resolution of 600×600 dpi (in a 2×2 matrix form). In this case, the host computer is required only to process data with a resolution as low as 300 dpi, and thus the burden of the host computer is reduced. Furthermore, the data to be transferred from the host computer to the printer is reduced in size to a value corresponding to 300×300 dpi each represented by 3 bits, which is only 75% of the data size required for bilevel data of a resolution of 600×600 dpi. This technique based on the matrix pattern is useful particularly for dealing with images such as photographs in which representation of halftone is more important than sharpness at edges in contrast to graphical images or graphs in which sharpness is more important.

When an image is recorded on plain paper serving as a recording medium by means of the ink-jet recording technique, the water resisting property of the recorded image is not good enough. When a color image is recorded using the ink-jet recording technique, it is difficult to meet simultaneously both requirements of small feathering in a high-density image and small bleeding between different colors. In other words, the problem of the conventional ink-jet recording technique is that it is difficult to obtain a color image that simultaneously satisfies both requirements of high quality and high durability.

One known technique of improving the resistance of printed images to water is to employ an ink containing a color material having resistance to water. Although the ink of this type is practically used recently, the property of resistance to water is not sufficient. Besides, because such an ink hardly dissolves in water after being dried, the nozzles of the recording head are easily clogged with dried ink. A complicated mechanism is required to prevent the nozzles from being clogged.

There are a large number of known techniques for improving the durability of a recorded image.

For example Japanese Patent Laid-Open No. 58-128862 discloses an ink-jet recording technique in which the positions of dots at which ink will be fired are determined before starting to record an image, and a recording ink and a processing ink are fired at the same dots. In this technique, drawing may first be performed with processing ink before the operation using a recording ink, or the processing ink may be used after the image was drawn using the recording ink so that the processing ink is put on the dots formed by the recording ink. Furthermore, the processing ink may again be put on the top of the dots formed by putting the recording ink on the bottom layer of processing ink. In Japanese Patent Laid-Open No. 8-52867 filed by the present applicant. there is disclosed an ink-jet recording technique in which a processing liquid is applied to every predetermined number of pixels. Japanese Patent Laid-Open No. 9-226154 discloses a technique in which a processing liquid is applied to all inked dots located at edges of a printed image while the processing liquid is applied to every predetermined number of inked dots at the other locations thereby achieving high resistance to water using the minimum amount of processing liquid.

However, if the processing liquid is applied to all inked dots detected at edges of an image to ensure the application of the processing liquid, the amount of the processing liquid applied to dots can become too much depending on the image recorded. Such an excessive application of the processing liquid results in an increase in running cost and can cause the recorded image to have distortion due to absorption of water into paper. These disadvantages in the conventional techniques are described in further detail below with reference to FIG. 18.

In a specific example shown in FIG. 18, an image is formed with an array of 600-dpi pixel. In other words, each pixel has a size of about 42 μm. A processing liquid expands on paper and forms a dot with a diameter of about 80 μm. Because the processing liquid expands over an area greater than a pixel size, it is not necessary to put the processing liquid on every pixels except for pixels located at edges of an image, and sufficiently high quality can be achieved in the printed image only by applying the processing liquid to every pair of pixels, for example. Although in FIG. 18 each inked dot forming the image has a diameter similar to the size of each pixel, the actual diameter of inked dots is usually 1.4 times the grid space so as to meet the requirement in terms of the area factor at a duty factor of 100%. To achieve a good fixing function, it is desirable to employ a processing liquid of the type exhibiting high penetration. If a processing liquid with high penetration property is used, the processing liquid penetrates, after being deposited on paper, into the paper not only in a depth direction but also in lateral directions. This allows the processing liquid deposited on paper to easily expand to a large size.

FIG. 18A illustrates an example of a recorded image in which ink is applied to those pixels in a shaded area. A processing liquid is applied to all pixels at the edges of the image while the processing liquid is applied to every pair of pixels at the other locations as shown in FIG. 18B. The pixels at the edges are extracted by detecting a transition from a non-inked pixel to an inked pixel in the horizontal direction. As can be seen from FIGS. 18A and 18B, the processing liquid is applied to only six pixels of ten inked pixels. Thus, a reduction in consumption of processing liquid is achieved. However, in the case where the recording data has a checker pattern such as that shown in FIG. 18C, all inked pixels are located at edges and thus the processing liquid is applied to all inked pixels as shown in FIG. 18D. In the specific example shown in FIG. 18D, the processing liquid is applied to all eight inked pixels. The processing liquid expands on the paper into adjacent non-inked pixels which need no processing liquid. Such an excessive application of the processing liquid causes the recording paper to be bent or cockled thus causing distortion in the recorded image. Another result of the excessive application of the processing liquid is an increase in running cost.

When data is converted to bilevel data in accordance with the error diffusion technique, it is impossible to control the manner of converting a given image to data, and therefore the resultant recorded image can include a large number of inked pixels located at edges as is the case in the example shown in FIG. 18C and thus the processing liquid is applied excessively. However, if recording is performed using matrix patterns, it is possible to control the locations of dots within each matrix.

SUMMARY OF THE INVENTION

In view of the above, it is an object of the present invention to provide an ink-jet recording apparatus, an ink-jet recording method, and an image processing apparatus in which an image is recorded using a matrix pattern which is selected so as to minimize the number of inked dots at edges thereby minimizing the amount of processing liquid applied to the inked dots thus achieving a high-quality image having no distortion and a reduction in the running cost.

According to an aspect of the present invention, there is provided an ink-jet recording apparatus for recording on a recording medium using an ink emission part for emitting an ink and a liquid emission part for emitting a liquid which acts on an ink when it comes into contact with the ink, the ink-jet recording apparatus comprising: recording control means for controlling the operation of the ink emission part so that recording is performed by the ink emission part using a matrix pattern. representing which pixel of a matrix is to be inked, the matrix consisting of a plurality of pixels located at L (integer equal to or greater than 2)×M (integer equal to or greater than 2) array positions wherein if the matrix pattern includes a plurality of pixels to be inked, the plurality of pixels to be inked are located at successive array positions in a predetermined direction; and liquid emission control means for controlling the operation of the liquid emission part so that the liquid is emitted from the liquid emission part toward a particular pixel of the plurality of pixels to be inked located at successive pixel positions in the predetermined direction, the particular pixel being located at a transitional boundary from a pixel not to be inked to a pixel to be inked.

According to another aspect of the invention, there is provided an ink-jet recording method for recording by applying an ink and a liquid to a recording medium, the liquid having the capability of acting on the ink when the liquid comes into contact with the ink, the method comprising the steps of: applying the ink to the recording medium using a matrix pattern representing which pixel of a matrix is to be inked, the matrix consisting of a plurality of pixels located at L (integer equal to or greater than 2)×M (integer equal to or greater than 2) array positions wherein if the matrix pattern includes a plurality of pixels to be inked, the plurality of pixels to be inked are located at successive array positions in a predetermined direction; and emitting the liquid to a particular pixel of the plurality of pixels to be inked located at successive pixel positions in the predetermined direction, the particular pixel being located at a transitional boundary from a pixel not to be inked to a pixel to be inked.

According to still another aspect of the present invention, there is provided an image processing apparatus for processing input image data so as to generate data used by an ink-jet recording apparatus for recording on a recording medium using an ink emission part for emitting an ink and a liquid emission part for emitting a liquid which acts on an ink when it comes into contact with the ink, the image processing apparatus comprising: ink emission data output means for outputting, to the ink-jet recording apparatus, ink emission data according to which the ink emission part performs recording by using a matrix pattern representing which pixel of a matrix is to be inked, the matrix consisting of a plurality of pixels located at L (integer equal to or greater than 2)×M (integer equal to or greater than 2) array positions wherein if the matrix pattern includes a plurality of pixels to be inked, the plurality of pixels to be inked are located at successive array positions in a predetermined direction; and liquid emission data output means for outputting liquid emission data, to the ink-jet recording apparatus, liquid emission data according to which the liquid emission part emits the liquid to a particular pixel of the plurality of pixels to be inked located at successive pixel positions in the predetermined direction, the particular pixel being located at a transitional boundary from a pixel not to be inked to a pixel to be inked.

According to still another aspect of the present invention, there is provided an ink-jet recording apparatus for recording on a recording medium using an ink emission part for emitting an ink and a liquid emission part for emitting a liquid which acts on an ink when it comes into contact with the ink, the ink-jet recording apparatus comprising:

a receiving unit for receiving transmitted image data, the image data representing an n-level gray scale where n is an integer equal to or greater than 3;

pattern storage means for storing a plurality of matrix patterns corresponding to the respective levels of the gray scale, the matrix patterns each representing a particular pixel at which a dot is formed in a matrix consisting of a plurality of pixels located at L (integer equal to or greater than 2)×M (integer equal to or greater than 2) array positions, wherein if any matrix pattern corresponding to a particular level of the gray scale includes a plurality of pixels to be inked, the plurality of pixels to be inked are located at successive array positions in a predetermined direction; and recording control means for generating ink emission data representing which pixel is to be inked, the ink emission data being generated by converting the image data received via the receiving unit to a matrix pattern selected from the matrix patterns stored in the pattern storage means depending on the level of the gray scale indicated by the image data, further determining, on the basis of the ink emission data, the pixel location to which the liquid is emitted, and then emitting the ink from the ink emission part in accordance with the ink emission data and also emitting the liquid from the liquid emission part thereby recording an image corresponding to the image data on the recording medium.

According to still another aspect of the present invention, there is provided a recording method of recording on a recording medium using an ink-jet recording apparatus, the recording being performed using an ink emission part for emitting an ink and a liquid emission part for emitting a liquid which acts on an ink when it comes into contact with the ink, the method comprising the steps of:

receiving transmitted image data, the image data representing an n-level gray scale where n is an integer equal to or greater than 3;

generating ink emission data representing which pixel is to be inked, in accordance with a matrix pattern corresponding to the level of the gray scale indicated by the received image data, the matrix pattern representing a particular pixel at which a dot is formed in a matrix consisting of a plurality of pixels located at L (integer equal to or greater than 2)×M (integer equal to or greater than 2) array positions, wherein if the matrix pattern corresponding to a particular level of the gray scale includes a plurality of pixels to be inked, the plurality of pixels to be inked are located at successive array positions in a predetermined direction;

determining, on the basis of the ink emission data, the pixel location to which the liquid is emitted, and emitting the ink from the ink emission part in accordance with the ink emission data and also emitting the liquid from the liquid emission part thereby recording an image corresponding to the image data on the recording medium.

According to still another aspect of the present invention, there is provided a method of outputting data to an ink-jet recording apparatus from a host apparatus connected to the recording apparatus, the method comprising the steps of:

generating image data representing an n-level gray scale in accordance with an image to be recorded;

generating pattern designation data in accordance with the generated image data, the pattern designation data designating a matrix pattern corresponding to a particular level of the gray scale of the image data, the matrix patterns each representing a particular pixel at which a dot is formed in a matrix consisting of a plurality of pixels located at L (integer equal to or greater than 2)×M (integer equal to or greater than 2) array positions, wherein if any matrix pattern corresponding to a particular level of the gray scale includes a plurality of pixels to be inked, the plurality of pixels to be inked are located at successive array positions in a predetermined direction; and outputting the data designating the matrix pattern to the ink-jet recording apparatus connected to the host apparatus.

Herein in the present description, the "processing liquid" refers to a liquid which acts on an ink when it comes into contact with the ink. An example of the processing liquid is a liquid including a component which makes the color material in the ink insoluble or aggregated thereby improving the resistance of the recorded image to water, increasing the density of the image, and preventing bleeding and feathering thus making it possible to achieve a high-quality image.

BRIEF DESCRIPTION OF THE DRAWINGS

FIGS. 2A, 2B, and 2C are schematic diagrams illustrating matrix patterns according to the first embodiment of the invention;

FIG. 17 is a schematic diagram illustrating the method of selecting a matrix pattern according to the fourth embodiment of the invention.

DESCRIPTION OF THE PREFERRED EMBODIMENTS

The present invention is described in further detail below with reference to preferred embodiments in conjunction with the accompanying drawings.

First Embodiment

Figure 1:
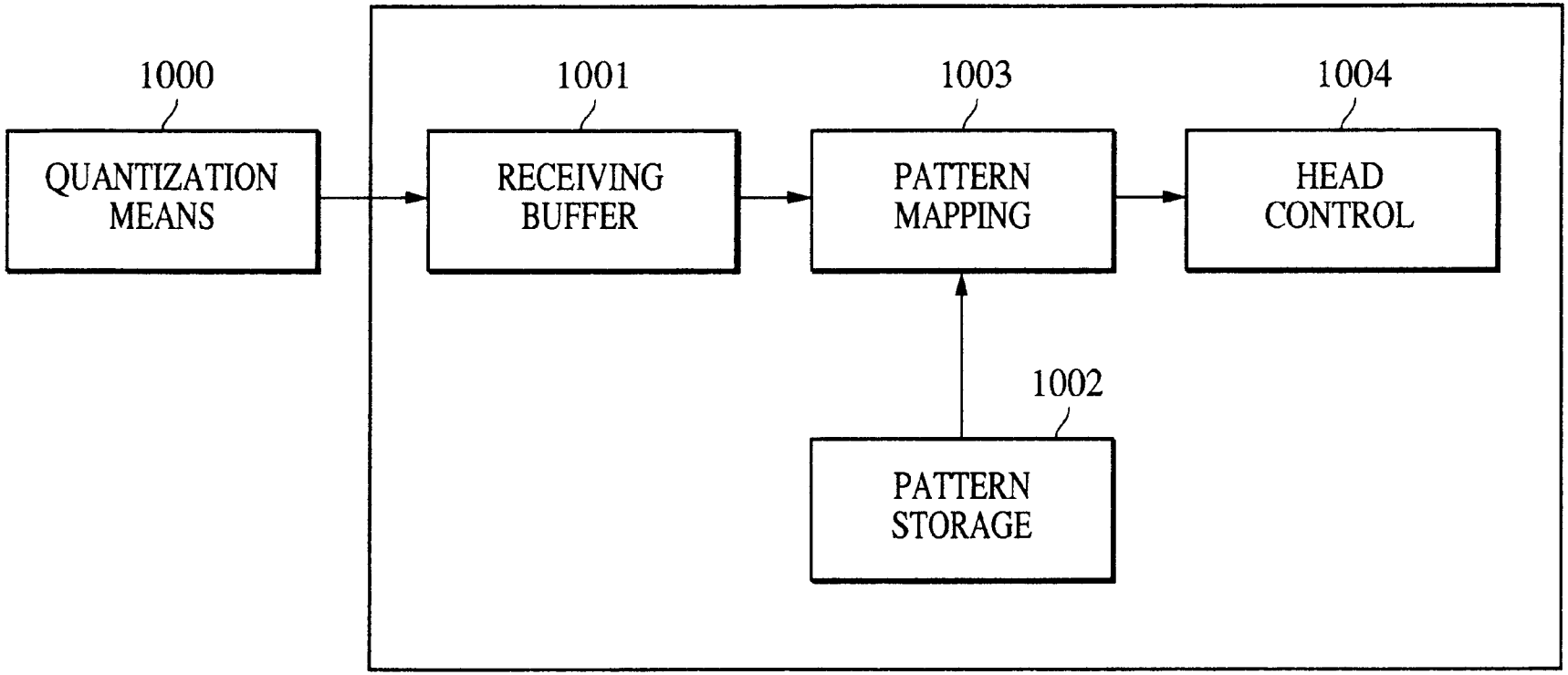
FIG. 1 is a block diagram illustrating a first embodiment of the invention.

FIG. 1 is a block diagram illustrating a first embodiment of the invention. The system according to the first embodiment includes a receiving buffer 1001 for receiving quantized data from quantization means 1000, pattern storage means 1002 for storing matrix patterns, pattern conversion means 1003 for converting the quantized data to bit map data by referring to the matrix patterns stored in the pattern storage means 1002, head control means 1004 for driving a print head in accordance with the bit map data. Herein, the quantization means is realized by a host computer.

In the present embodiment, the quantization means 1000 generates 5-level data with a resolution of 300×300 dpi, and the printer converts the data received from the quantization means 1000 to data with a resolution of 600×600 dpi using a 2×2 dot matrix.

FIGS. 2A, 2B and 2C illustrate patterns used herein in the present embodiment. FIG. 2A illustrates the concept of the method of converting input data to 5-level data. The input data is thresholded, that is, quantized, dot by dot to either one of 5 levels LEVEL0 to LEVEL4 according to the input level. FIG. 2B illustrates matrix patterns corresponding to the respective output levels. In this specific embodiment, each matrix includes 2×2 elements (dots) and thus 5 different levels can be represented by properly selecting the number of inked elements (dots) within each matrix.

The mapping to a matrix pattern is described in further detail below for the case where the data has a level of LEVEL2. The LEVEL2 is represented by two dots assigned in the 2×2 matrix. In this specific embodiment of the invention, the two dots to be inked are assigned at right and left elements in the upper line in the matrix. If two dots are assigned to elements at such locations, the number of dots of processing liquid can be reduced compared to the case where two dots are assigned as shown in FIG. 2C.

Figure 3:
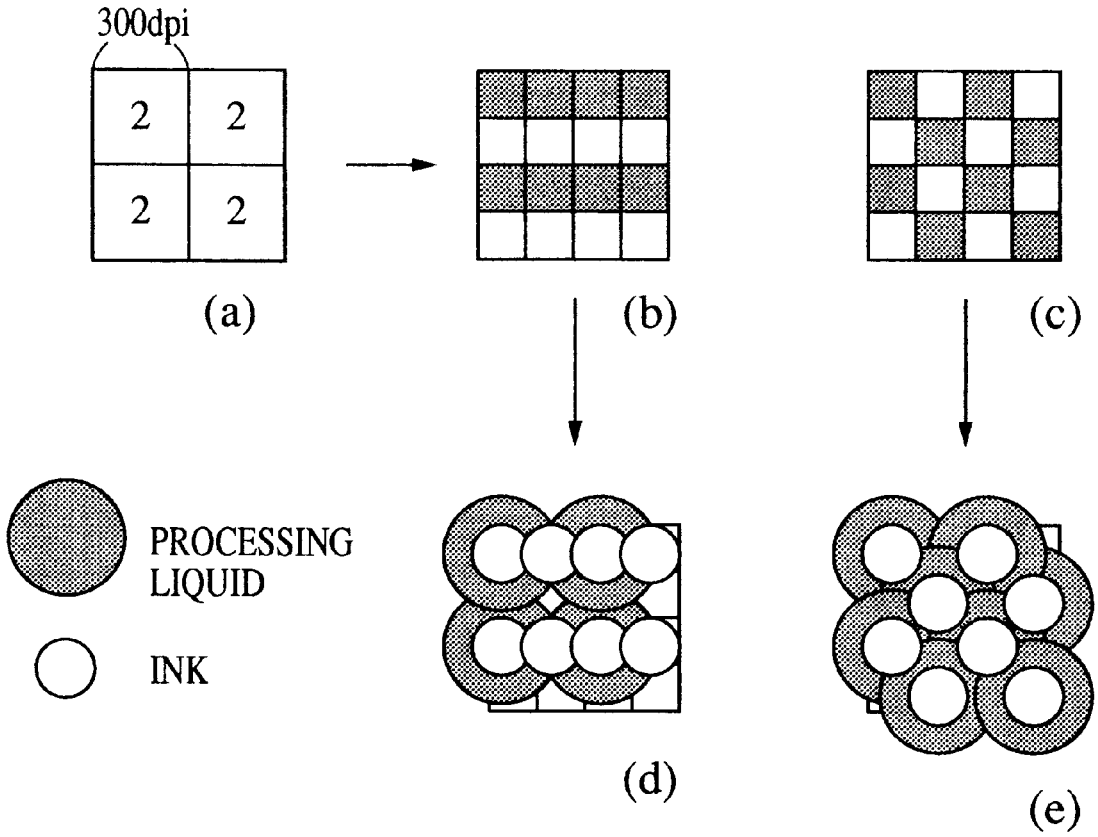
FIGS. 3A, 3B, 3C, 3D and 3E are schematic diagram illustrating the method of applying a processing liquid according to the first embodiment of the invention.

The reason for this is described below with reference to FIG. 3A. FIG. 3A illustrates 5-level quantized data at the respective pixel locations of a 300×300 dpi matrix. In this specific example, all pixels have a value of LEVEL2. If LEVEL2 is represented by the matrix in which two dots on right and left sides in the upper line are assigned as the dots to be inked, then the image is mapped and printed by the printer as shown in FIG. 3B. FIGS. 3B and 3C illustrate matrices with a density of 600 dpi. If a processing liquid is applied in such a manner that the processing liquid is applied to all inked dots located at edges but the processing liquid is applied to every two inked dots at the other locations, then ink and processing liquid are applied to dots as shown in FIG. 3D. That is, ink is applied to 8 dots and a processing liquid is applied to 4 dots of the 8 inked dots. Herein, the dots at the edges can be extracted by detecting a transition from a non-inked dot to an inked dot in the horizontal line. To apply the processing liquid to every two inked dots at any location except for the edges, every two inked dots are extracted starting from an edge.

If LEVEL2 is represented by the matrix shown in FIG. 2C instead of being represented by the above-described matrix, then the image shown in FIG. 3A is mapped as shown in FIG. 3C. In this case, all dots are detected to be located at edges in the process of applying the processing liquid. Thus the processing liquid is applied to all inked dots as shown in FIG. 3E. As can be understood from comparison between FIGS. 3D and 3E, although 8 dots are inked in both cases, the processing liquid is applied to only 4 dots in FIG. 3D in contrast to FIG. 3D in which the processing liquid is applied to 8 dots. When the processing liquid expands on the paper, a great amount of processing liquid expands into non-inked dots in the case of FIG. 3E and thus the processing liquid is used excessively. In contrast, although the processing liquid is not applied directly to some inked dots in the case of FIG. 3D, the processing liquid expands into such dots from adjacent dots and thus those dots which do not directly receive the processing liquid are also improved in the print quality to a similar extent to that where the print quality of the inked dots which directly receive the processing liquid is improved.

In the present invention, as described above, output data obtained by quantizing input data is mapped to a matrix pattern corresponding to the output level so that the inked dots are successively arranged in a particular direction thereby preventing an excessive application of the processing liquid thus achieving a reduction in the running cost and preventing degradation in the quality of the printed image.

Although in the present embodiment the processing liquid is applied to every two inked dots at locations other than edges, the processing ink may be applied to inked dots in a different fashion. That is, the processing ink may be applied to every greater or smaller number of inked dots depending on the characteristics of the processing liquid and the ink employed.

Furthermore, although in the present embodiment described above, data with a resolution of 300×300 dpi is mapped to data with a resolution of 600×600 dpi using 2×2 matrix patterns, the mapping may also be performed in a different fashion. For example, data may be converted to data with a resolution of 1200×600 dpi using 4×2 matrix patterns. In this case, the above-described advantages of the present invention can also be achieved by selecting matrix patterns in which inked dots are located at successive array positions in a particular direction.

Still furthermore, although in the present embodiment described above, edges are extracted by detecting a transition from a non-inked dot to an inked dot in the horizontal direction, edges may also be extracted by detecting a transition from a non-inked dot to an inked dot in the vertical direction. In this case, the data is preferably mapped to matrix patterns so that the inked dots are successively arranged in the vertical direction along as long a length as possible.

Figure 4:
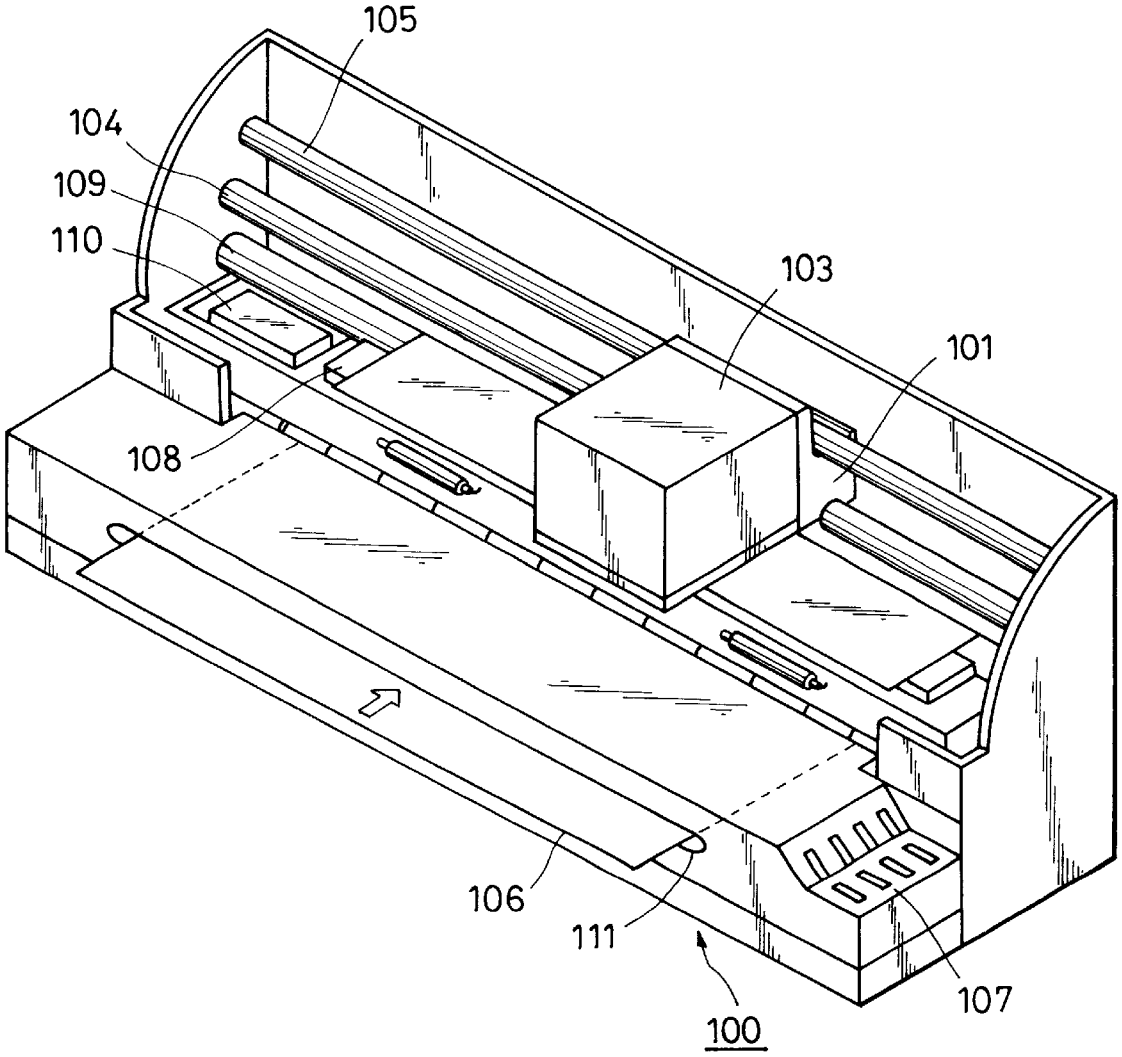
FIG. 4 is a perspective view of a recording apparatus which can be used in the present invention.

FIG. 4 illustrates an example of an ink-jet recording apparatus to which the present invention can be applied. A recording medium 106 is inserted into a slot to a paper feeding position of the recording apparatus 100. The recording medium 106 is carried by a paper feeding roller 109 to the recording area in which recording is performed by a recording head unit 103. There is a platen 108 in the recording area below the recording medium. There is provided a carriage 101 movable across the recording area back and forth in directions determined by two guide shafts 104 and 105. The recording head unit 103 is mounted on the carriage 101 wherein the recording head unit 103 includes recording heads for emitting a plurality of color inks and a processing liquid and also includes ink tanks for supplying the inks and the processing liquid to the corresponding recording heads. In this specific example of the ink-jet recording apparatus, four color inks of black (Bk), cyan (C), magenta (M), and yellow (Y) are available.

A recovery unit 110 is disposed at a lower position of the apparatus and at the left end of the area across which the carriage moves. When recording is not performed, the ink emitting orifices of the recording heads are covered with an elastic cap to prevent the ink emission orifices from becoming dry. This left end of the area is referred to as the home position of the recording head.

In FIG. 4, reference numeral 107 denotes a switch/display unit. The switch/display unit includes a power switch and other various switches used to set the recording modes, and also includes various display elements for indicating operation status.

Figure 5:
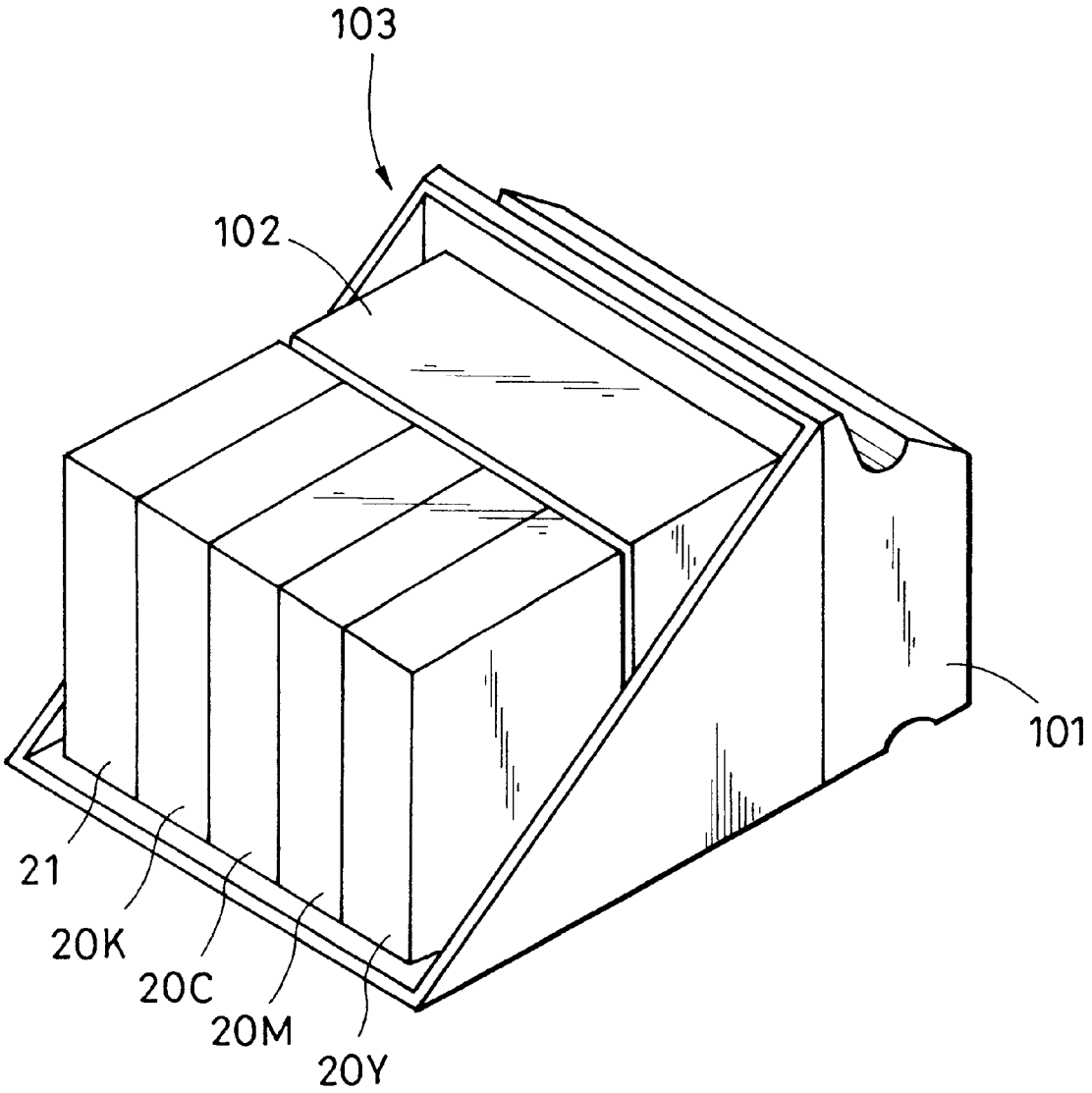
FIG. 5 is a perspective view of a recording head unit which can be used in the present invention.

FIG. 5 is a perspective view of the recording head unit 103. In this example, the recording head unit 103 includes a recording head for emitting inks with colors of black, cyan, magenta, and yellow.

On the carriage 101, are mounted the recording head 102 for emitting inks Bk, C, M, and Y and the processing liquid, a Bk ink tank 20K, a C ink tank 20C, an M ink tank 20M, a Y ink tank 20Y, and a processing liquid tank 21, which can be replaced independently of each other. These tanks are connected to the recording head via a connection element (not shown) so that the inks and the processing liquid are supplied to the emission orifices of the recording head.

Instead of employing the above structure, a plurality of tanks may be integrated into a single piece. For example, the processing liquid tank and the Bk ink tank may be combined into an integrated form, and/or the C, M, and Y ink tanks may be combined into an integrated form.

Figure 6:
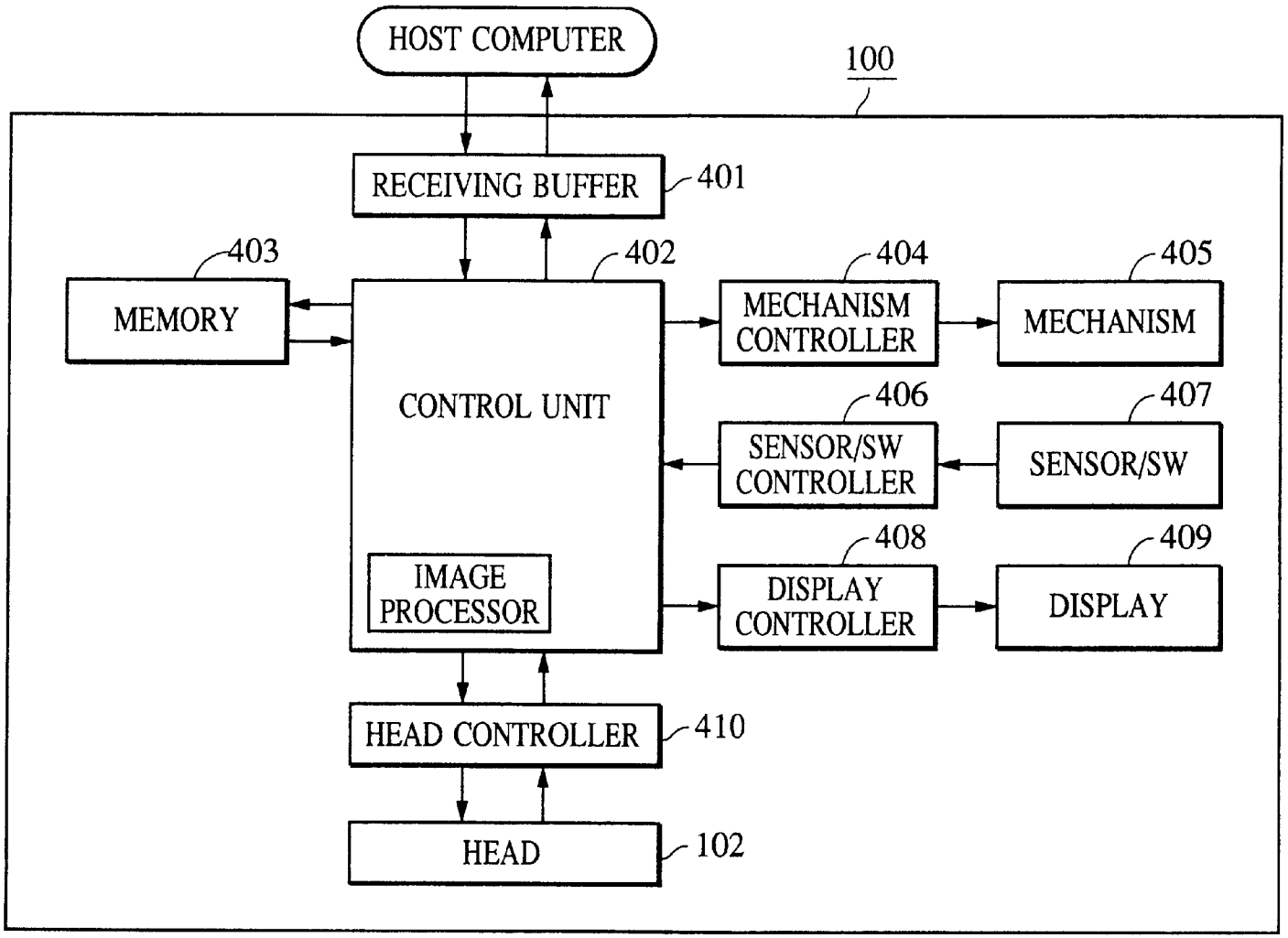
FIG. 6 is a block diagram of the recording apparatus which can be used in the present invention.

FIG. 6 is a block diagram of the ink-jet recording apparatus according to the present invention. Data associated with characters or images to be recorded (hereinafter referred to simply as image data) is transferred from a host computer to a receiving buffer 401 of the recording apparatus. The recording apparatus transmits data to the host computer to inform whether the image data is correctly received and also what operation status the recording apparatus is in. Under the control of a CPU 402 serving as a control unit, the data received by the receiving buffer 401 is transferred to a memory (in the form of a RAM (random access memory)) 403 and stored therein temporarily. A mechanism controller 404 drives mechanisms 405 such as a carriage motor, a line feed motor, etc., in accordance with a command given by the CPU 402. A sensor/SW controller 406 receives signals from a sensor/SW unit 407 including various sensors and switches (SW) and transmits the received signals to the CPU 402. Under the control of the CPU 402, a display controller 408 controls the operation of a display unit 409 including LEDs and/or liquid crystal display devices disposed on a display panel. A recording head controller 410 controls the operation of the recording head 102 in accordance with a command given by the CPU 402. The recording head controller 410 also detects the conditions such as the temperature of the recording head 102 and transfers the detected data to the CPU 402.

In the first embodiment of the invention, as described above, a sufficient amount of processing liquid is applied to the inked dots without causing an excessive application of the processing liquid.

That is, the present embodiment of the invention makes it possible to obtain a high-quality image with high resistance to water by applying a minimized amount of processing liquid.

Second Embodiment

The first embodiment described above can be expanded such that two different matrix patterns are combined as described below.

Figure 7:
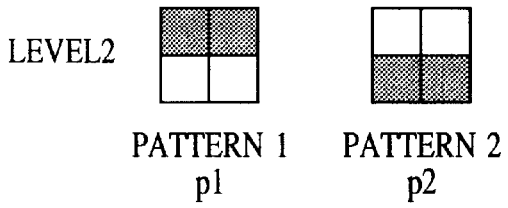
FIG. 7 is a schematic diagram illustrating matrix patterns according to a second embodiment of the present invention.

In the present invention, as described in the first embodiment, LEVEL2 is represented by arranging two dots in a matrix so that the two dots are adjacent to each other in a particular direction. In this case, two dots may be arranged in either of two ways, and thus there can be two patterns (p1, p2) as shown in FIG. 7. In this second embodiment, the two patterns are properly combined so as to further reduce the amount of processing liquid applied to inked dots. Another advantage of this technique is that nozzles are used in a more even fashion.

Figure 8:
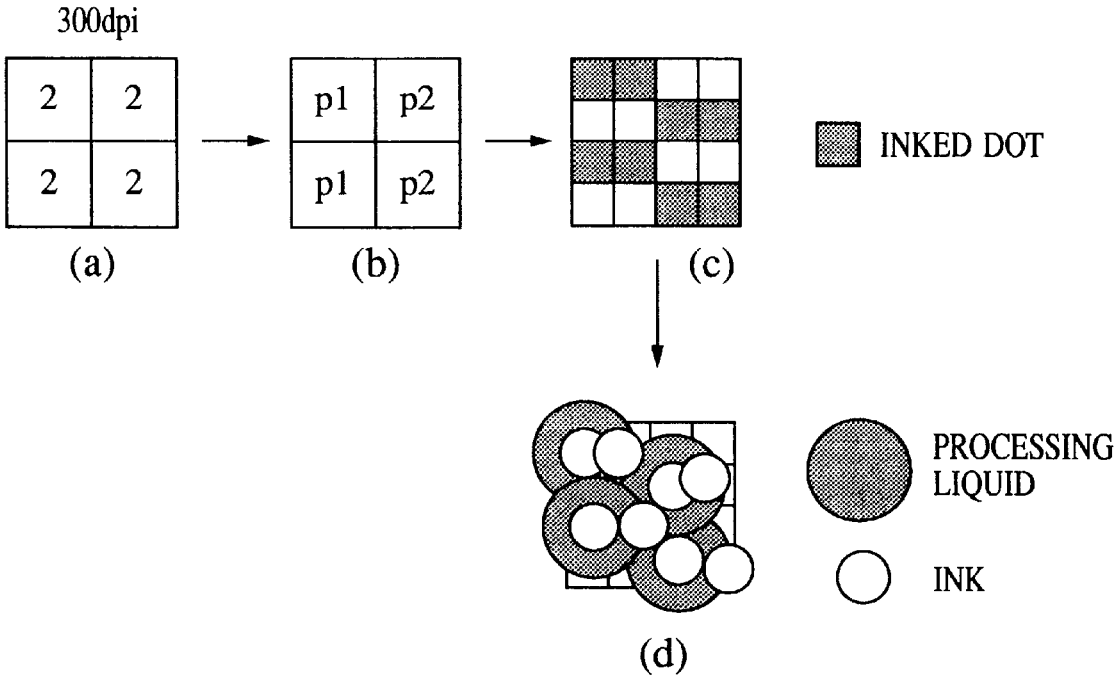
FIGS. 8A, 8B, 8C and 8D are schematic diagrams illustrating the method of generating data according to the second embodiment of the invention.

FIGS. 8A, 8B, 8C and 8D illustrate an example of the manner of applying ink and processing liquid. FIG. 8A illustrates a matrix with a resolution of 300×300 dpi wherein numerals in the respective matrix elements represent 5-level data (pixel values). In this specific example, all pixels have a value of LEVEL2. In this embodiment, as shown in FIG. 8B, the pixel values LEVEL2 are mapped alternately to either of the patterns p1 and p2 shown in FIG. 7. Thus dots to be inked are located as shown in FIG. 8C. As in the first embodiment, the processing liquid is applied to all inked dots detected at edges and applied to every two inked dots starting from each edge. Thus the ink and the processing liquid are applied as shown in FIG. 8D. Also in this case, the processing liquid is directly applied to four of eight inked dots.

In this second embodiment, as described above, the usage of two different dot patterns makes it possible to evenly use the nozzles for emitting processing liquid while applying a required amount of processing liquid to the inked dots without causing an excessive application of the processing liquid.

Figure 9:
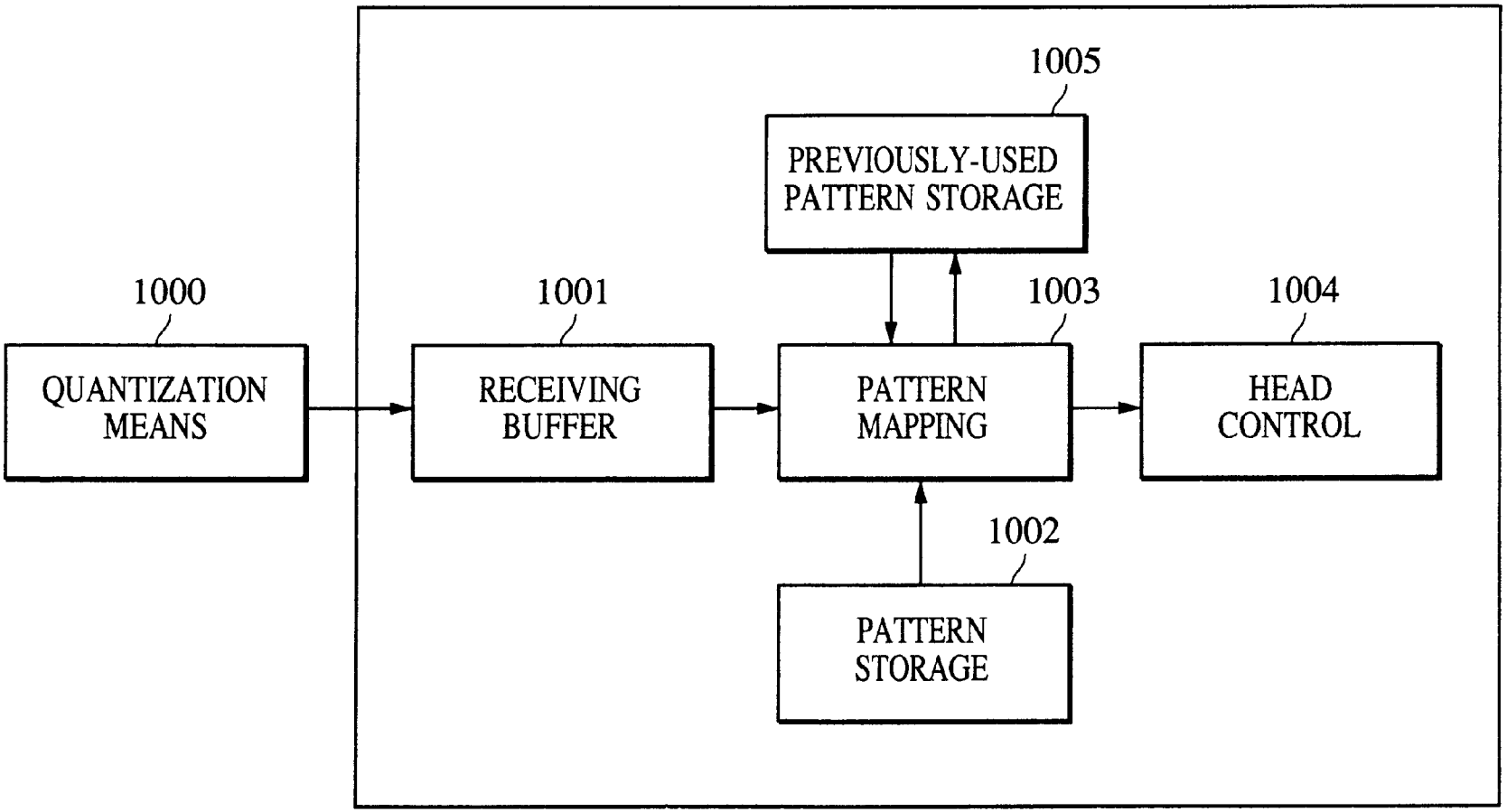
FIG. 9 is a block diagram illustrating the second embodiment of the invention.

FIG. 9 is a block diagram illustrating the system according to the present embodiment. The difference from the first embodiment described above with reference to FIG. 1 is that the system further includes previous pattern storage means 1005. Quantized data with a resolution of 300×300 output from quantization means 1000 is applied to a receiving buffer 1001 of a printer. If the received data has a value of LEVEL2, either pattern p1 or p2 is selected depending on the information stored in previous pattern storage means 1005. If the pattern p1 was used for the previous pixel having a value of LEVEL2, then the previous pattern storage means stores data indicating that the previously used pattern is p1. In this case, the pattern p2 is selected for the current pixel having a value of LEVEL2 on the basis of the information stored in the previous pattern storage means. If the pattern p2 is selected, pattern mapping means 1003 retrieves the pattern p2 for LEVEL2 from pattern storage means 1002 and converts the data to recording data with a resolution of 600×600 dpi using the pattern p2. The information stored in the previous pattern storage means 1005 is updated to indicate that the pattern p2 is used. In the case where the received data has a quantized value other than LEVEL2, there is only one possible pattern for any quantized value. Therefore, the data is mapped simply by retrieving the corresponding pattern from the pattern storage means 1002 as in the first embodiment.

Although in the second embodiment described above the two different patterns are used alternately, the two patterns may also be used in different fashions. For example, either pattern may be selected line by line, or one pattern may be used more frequently than the other pattern. Furthermore, the previous pattern storage means may be replaced by random number generation means so that two different patterns are selected randomly. In any case, the advantage described above can be achieved by employing two different patterns.

Still furthermore, although in the present embodiment the selection of matrix patterns is performed by the printer, the selection may be performed by the host computer (host device) connected to the printer and responsible for generation of image data. In this case, when the image data has a value of LEVEL2, the host computer selects either pattern p1 or p2 and outputs the resultant data. In this case, a printer having a similar construction to that used in the first embodiment may be employed wherein two different matrix patterns corresponding to LEVEL2 are stored in the pattern storage means.

The construction of the system in which the selection of matrix patterns is performed by the host computer is described in further detail below.

The ink-jet recording apparatus employed herein to record an image on a recording medium by emitting an ink and processing liquid is similar to that employed in the first embodiment. Matrix patterns representing dots to be inked are stored in the ink-jet recording apparatus. The matrix patterns include two matrix patterns pl and p2 corresponding to the pixel value of LEVEL2.

The host computer generates image data representing the pixel intensity levels (gray levels) of an image to be recorded, and further generates data indicating matrix patterns corresponding to the respective pixel intensity levels of the image data. The resultant data indicating the matrix patterns is output to the ink-jet recording apparatus. In the above operation, when the intensity level of a particular pixel has a plurality of candidates of matrix patterns such as p1 and p2, the host computer selects proper one and generates data indicating the selected pattern. That is, matrix patterns used in the printing operation are selected from a plurality of candidates by the host computer. More specifically, matrix patterns p1 and p2 are properly selected by the host computer so that nozzles are evenly used in the printing operation. The switching between these patterns may be performed either every data having the same intensity level, every recording line, or every recording sheet.

Third Embodiment

A third embodiment described herein discloses a technique of further improving the representation of halftone (pixel intensity levels) of a recorded image by using two different ink dots.

One well know technique of improving the representation of halftone is to use different types of ink dots to represent various levels for each pixel instead of turning on and off the same type of dots. More specifically, the representation of a plurality of intensity levels for each pixel can be accomplished either by using different types of inks which are similar in color but different in density or by varying the areas of dots using the same ink having a particular density. In this embodiment, the technique of using two different types of inks having a similar color but having different intensities is employed by way of example. Of these two types of inks, the ink used to form dots having a high intensity level is referred to as a high-density ink, and the ink used to form dots having a low intensity is referred to as a low-density ink.

Furthermore, the present embodiment employs, by way of example, the technique in which the host computer generates multilevel data with a resolution of 300×300 dpi and the printer converts the received data to data with a resolution of 600×600 dpi which are printed using inks with different densities. As in the first embodiment, the received data is mapped to 2×2 matrix patterns. Although in the case where only one type of ink is used, the data is quantized into five levels as in the first embodiment, it is possible to quantize the data to nine levels as shown in FIG. 10 in the case where dots are formed using two types of inks having high and low densities.

Figure 10:
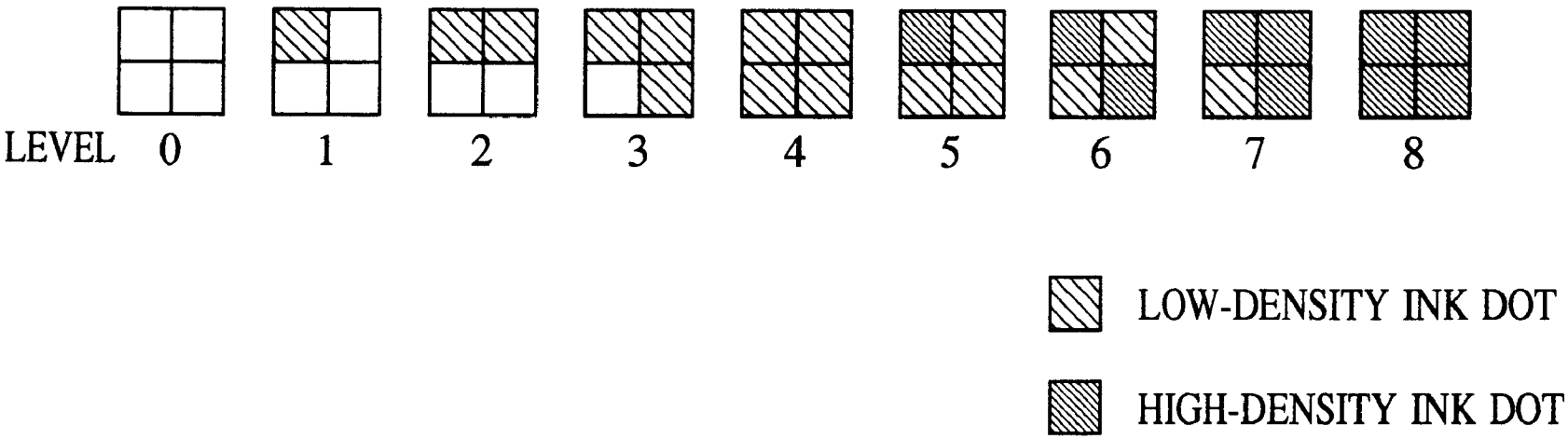
FIG. 10 is a schematic diagram illustrating examples of matrix patterns according to a third embodiment of the invention.
Figure 11A:
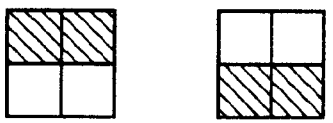
FIGS. 11A, 11B and 11C are schematic diagrams illustrating matrix patterns according to the third embodiment of the invention.
Figure 11B:
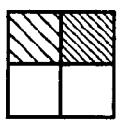
Figure 11B:
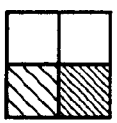
Figure 11C:
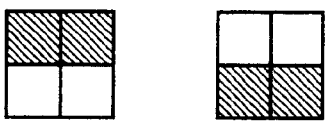

The set of patterns shown in FIG. 10 is only an example, and any other proper set of patterns may also be employed depending on the characteristics of inks and recording media employed. In any case, patterns are determined so that two inked dots are located at successive positions in a particular direction if possible thereby achieving the advantages of the present invention. For example, when two inked dots are put in a 2×2 matrix, there are three possible combinations: (i) two low-density dots are formed, (ii) one low-density dot and one high-density dot are formed, and (iii) two high-density dots are formed. These three possible combinations of two dots may be realized at various dot locations as shown in FIGS. 11A, 11B and 11C. The dot locations shown in FIG. 11A are possible for the combination (i), the dot location shown in FIG. 11B for the combination (ii), and the dot location shown in FIG. 11C for the combination (iii). In any case, two inked dots are put at successive locations in the same direction.

There can be a plurality of different patterns which can represent the same particular intensity level. One pattern selected from such a plurality of patterns may be employed or different patterns may be used depending on pixels as in the second embodiment. Furthermore, the pattern may be varied depending on the color.

Figure 12:
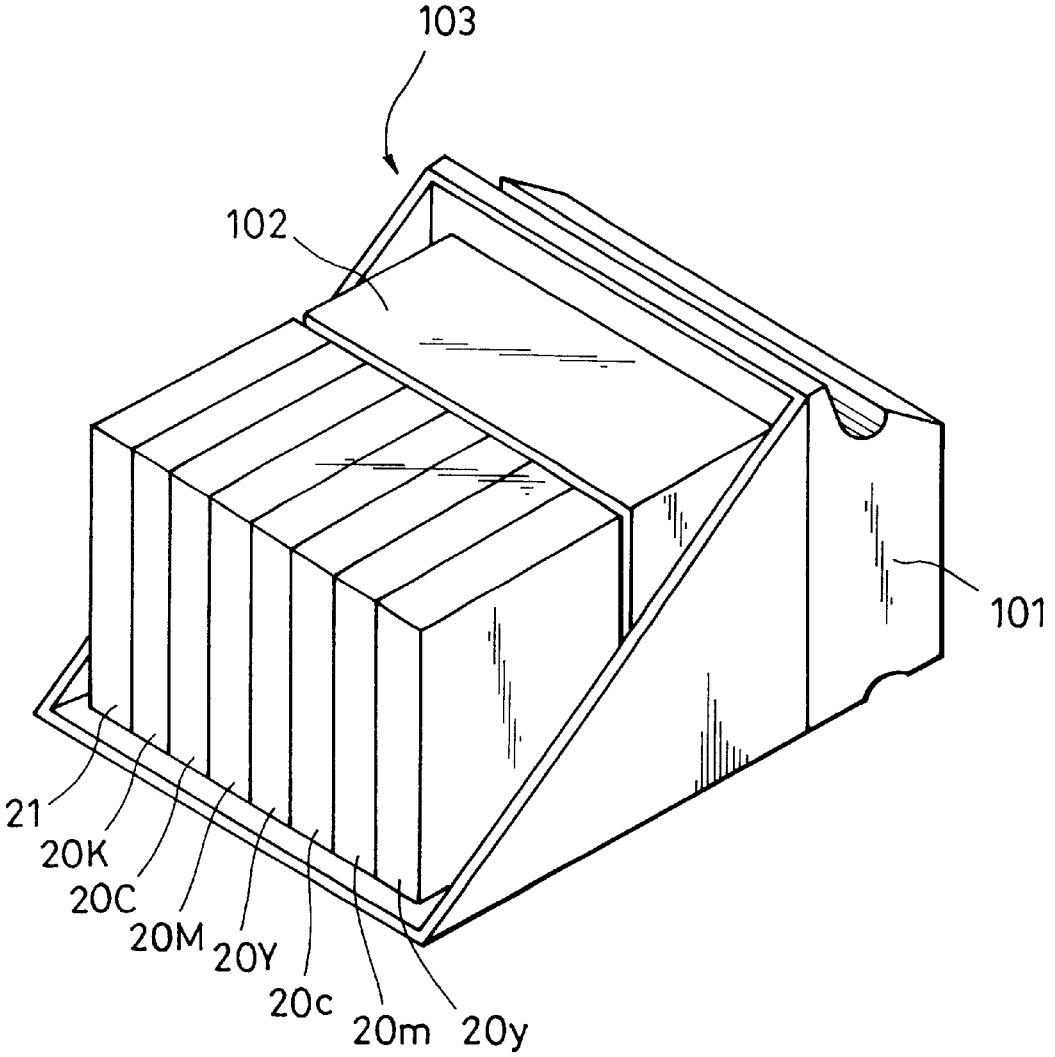
FIG. 12 is a schematic diagram illustrating a head unit which can be used in the third embodiment of the invention.

FIG. 12 illustrates an example of a recording head unit employed in the present embodiment. In this specific example shown in FIG. 12, the recording head unit includes a processing liquid and inks with colors of black (Bk), high-density cyan (C), high-density magenta (M), high-density yellow (Y), low-density cyan (c), low-density magenta (m), and low-density yellow (y) wherein any of tanks for storing the processing liquid and the color inks may be replaced separately from the others.

A recording head 102 including emission orifices via which the processing liquid and the recoding inks Bk, C, M, Y, c, m, and y are emitted, a Bk ink tank 20K, a C ink tank 20C, an M ink tank 20M, a Y ink tank 20Y, a c ink tank 20*c*, an m ink tank 20*m*, a y ink tank 20*y*, and a processing liquid tank 21 are mounted on a carriage 101. The respective tanks are connected to the recording head via connection elements (not shown) so that the inks with the above colors and the processing liquid are supplied to the recording head.

Alternatively, the processing liquid tank and the Bk ink tank may be combined into an integrated fashion, or the C, M, Y, c, m, and y ink tanks may be combined into an integrated fashion. Otherwise, ink tanks for inks having similar colors may be combined into an integrated fashion.

Furthermore, two inks having the same color of black but having different densities may be used.

Figure 13A:
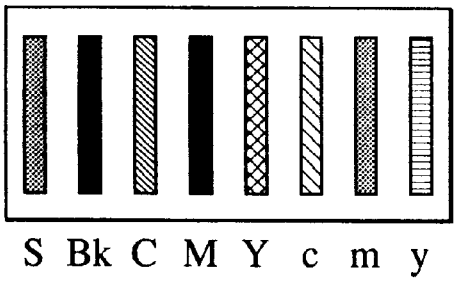
FIGS. 13A, 13B, and 13C are conceptual diagrams illustrating the emission orifices of the recording head.
Figure 13B:
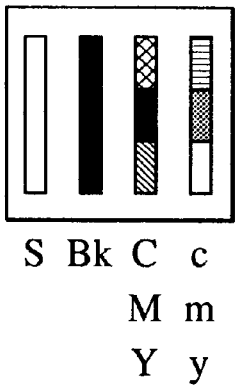
Figure 13C:
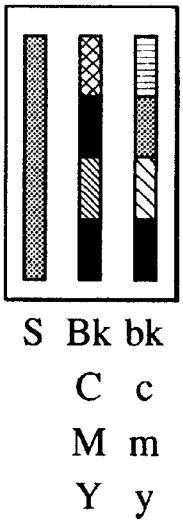

FIGS. 13A, 13B, and 13C are conceptual diagrams illustrating the structure of the recording head viewed from the side of a recording medium wherein some examples of arrangements of ink emission orifices which may be employed for the recording head are shown. In the example shown in FIG. 13A, emission orifices are formed separately for the recording inks Bk, C, M, Y, c, m, y and the processing liquid. FIG. 13B illustrates an example in which emission orifices for C, M, and Y inks are formed in one line and emission orifices for c, m, and y inks are formed in another line. In the example shown in FIG. 13C, the recording head is adapted to emit two types of black inks having high and low densities (Bk and bk inks) wherein emission orifices for Bk, C, M, and Y inks are formed in one line and emission orifices for bk, c, m, and y inks are formed in another line. Herein, the low-density black (bk) ink may be replaced with the high-density black ink so that the emission orifices bk and Bk are both used for emitting the black ink with the same density. The arrangement of the ink emission orifices is not limited to these examples shown in FIGS. 13A, 13B, and 13C, and other proper arrangements may also be employed.

In the third embodiment of the invention, as described above, a plurality of inks having a similar color but having different intensities are used and a sufficient amount of processing liquid is applied to the inked dots without causing an excessive application of the processing liquid. Thus the present embodiment makes it possible to obtain a high-quality image having a good halftone representation and having improved resistance to water using a minimized amount of processing liquid.

Fourth Embodiment

The fourth embodiment discloses a technique in which a plurality of patterns are assigned to one quantized level and an optimum pattern is selected from the plurality of patterns depending on the pattern employed for the previous pixel. By way of example, this embodiment employs one type of ink other than two types of inks having different densities.

Figure 14:
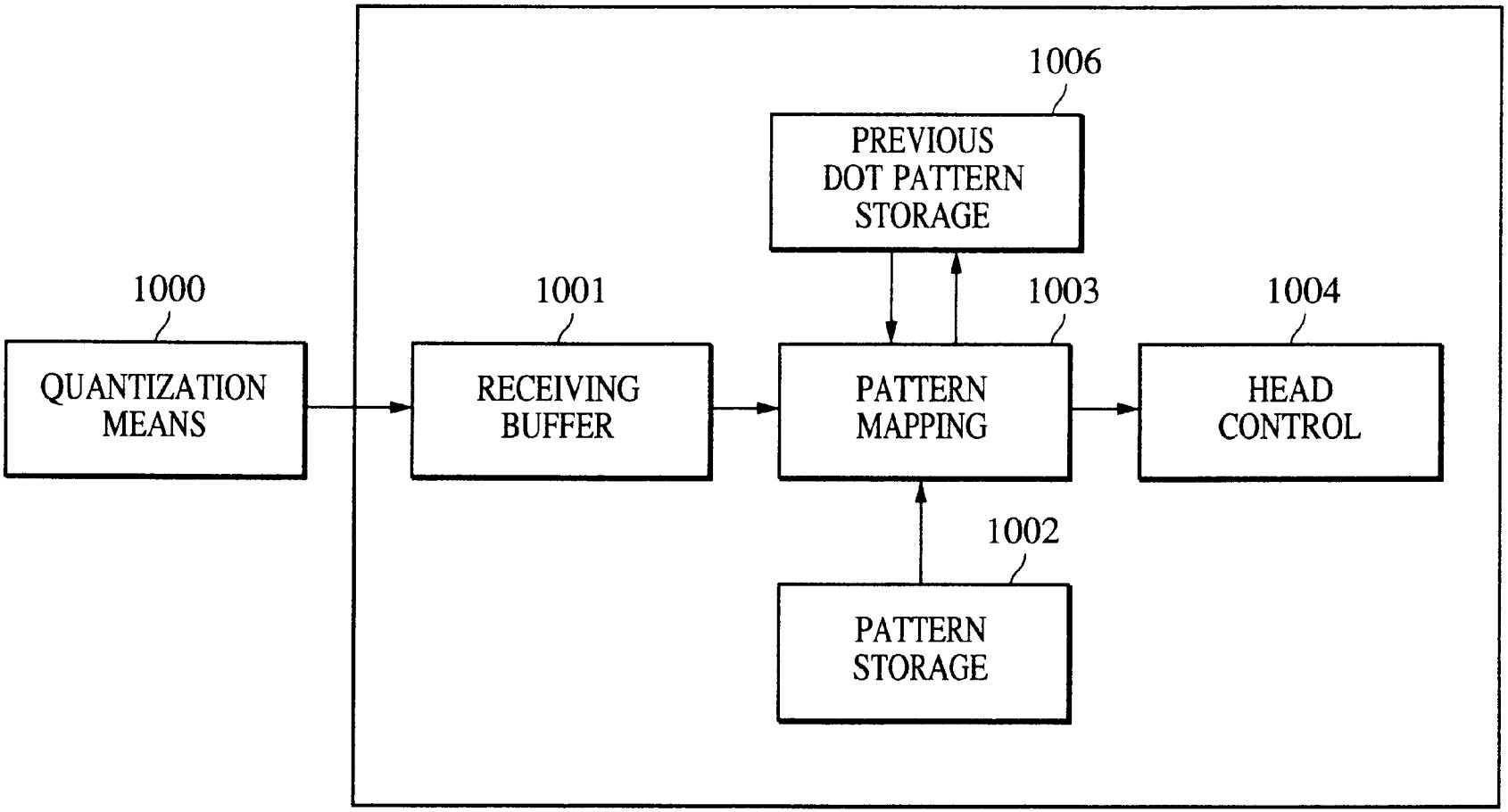
FIG. 14 is a block diagram illustrating a fourth embodiment of the invention.

FIG. 14 is a block diagram illustrating the construction of the fourth embodiment. As in the previous embodiments, the system includes quantization means 1000, a receiving buffer 1001, pattern storage means 1002, pattern mapping means 1003, and head control means 1004. In this embodiment, the system further includes previous pixel pattern storage means 1006.

Figure 15:
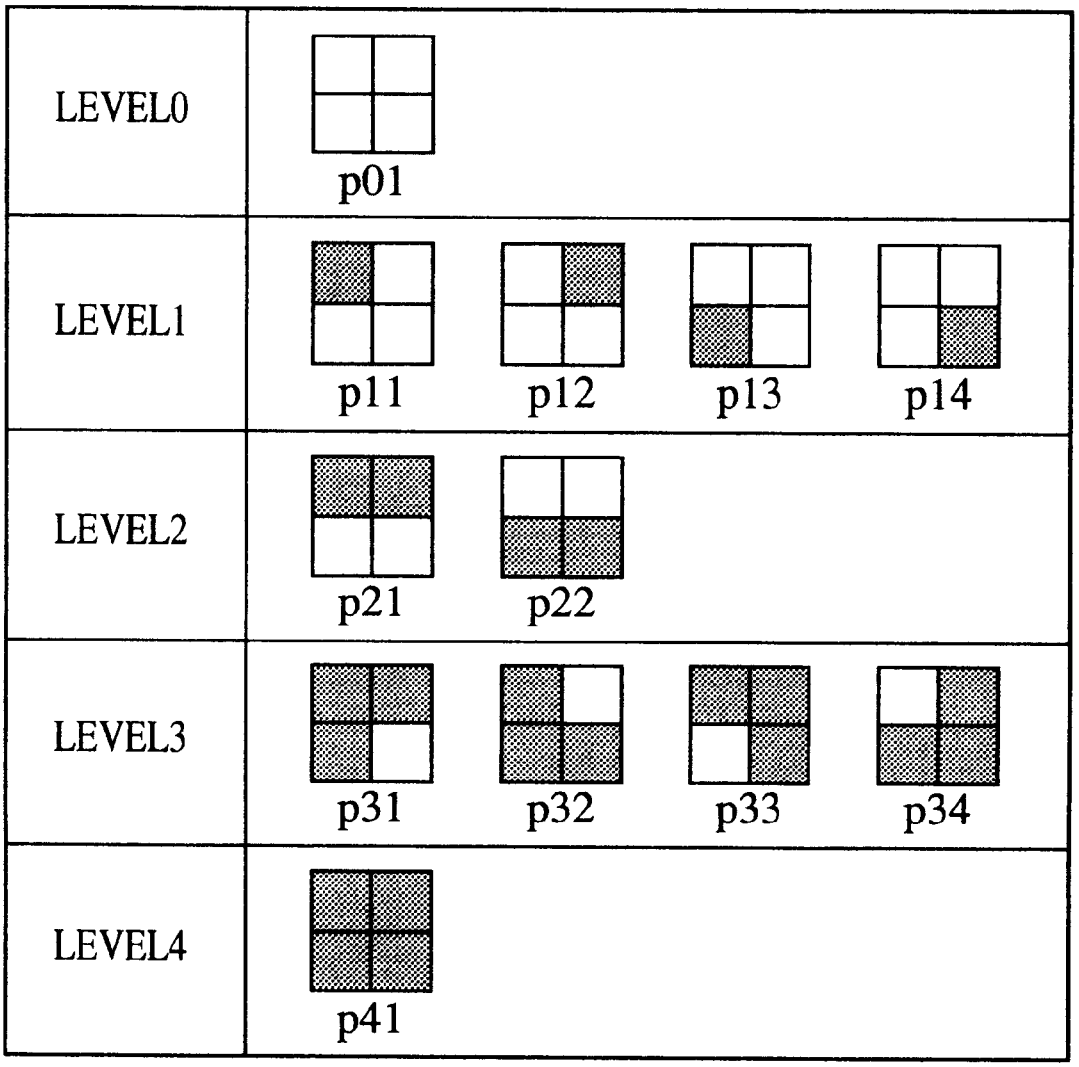
FIG. 15 is a schematic diagram illustrating matrix patterns according to the fourth embodiment of the invention.

FIG. 15 illustrates the patterns stored in the pattern storage means 1002. In this specific example, as can be seen from FIG. 15, the image data is quantized into five levels from LEVEL0 to LEVEL4, which are then mapped to matrix patterns in which inked dots are properly arranged depending on the level. Herein, the same number of inked dots can be arranged in various manners. That is, the same level can be represented by different matrix patterns. For example, LEVEL1 is represented by applying an ink to one dot in a matrix. Herein, the ink may be applied to a dot at any of four locations. Thus, LEVEL1 may be represented in four different manners by four different matrix patterns. Similarly, LEVEL3 can be represented in four different manners by four different matrix patterns each including three inked dots. On the other hand, LEVEL2 is represented by a matrix pattern including two inked dots. If two inked dots are selected so that they are located at successive positions in a particular direction, then two patterns are possible as shown in FIG. 15. LEVEL0 and LEVEL4 each have only one pattern. Hereinafter, the respective patterns are denoted by numbers p01–p41 as shown in FIG. 15.

The patterns p21 and p22 for LEVEL2 include two inked dots which are located at successive positions in the same direction as in the first embodiment. Such dot arrangements in the matrix pattern allow a reduction in the amount of processing liquid applied to inked dots compared to the case where inked dots are located diagonally in a matrix. The patterns p21 and p22 are similar to the patterns p1 and p2 employed in the second embodiment described above with reference to FIG. 7. Thus, as described in the second embodiment, the nozzles for emission of the processing liquid are used in a substantially even fashion if the patterns p21 and p22 are properly selected.

Figure 16:
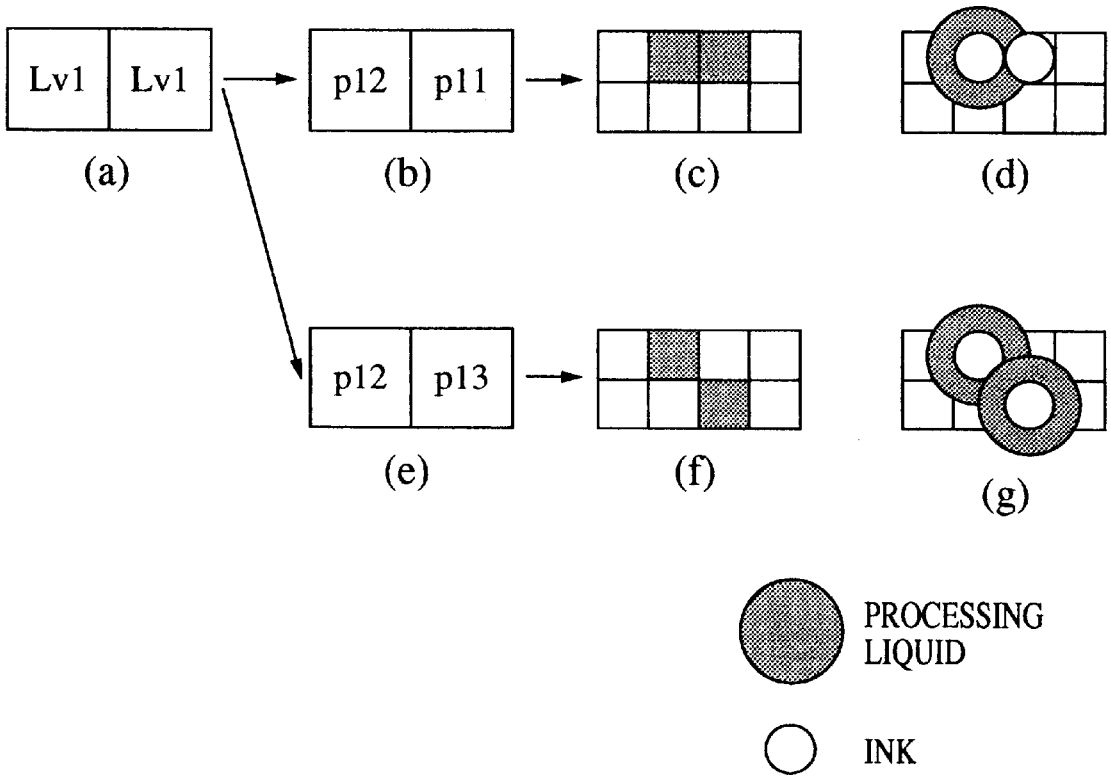
FIGS. 16A through 16G are schematic diagrams illustrating the method of applying ink and processing liquid and a matrix pattern used, according to the fourth embodiment of the invention.
Figure 18:
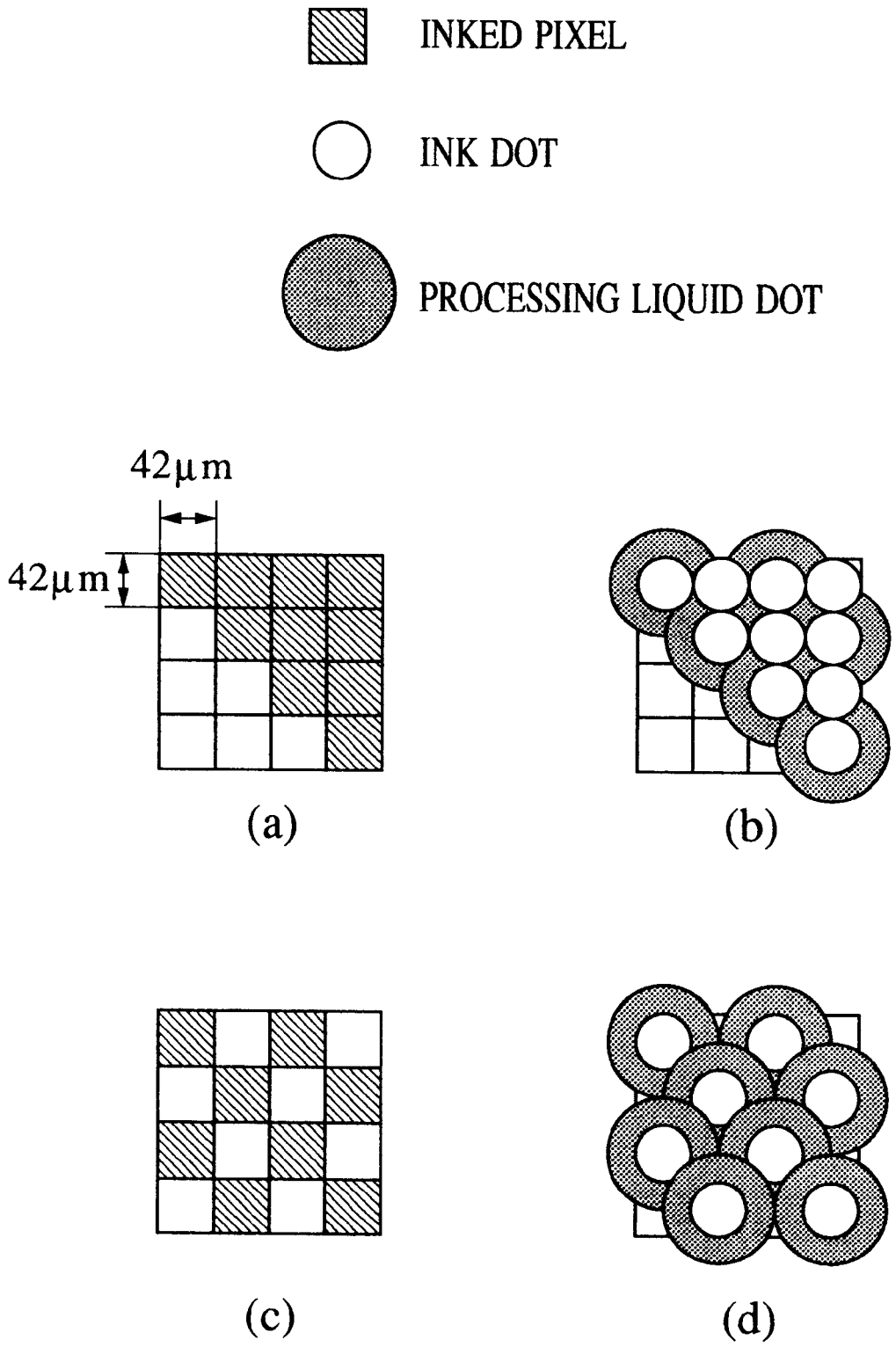
FIGS. 18*a* through 18*d* are diagrams illustrating an image to be recorded and a manner of applying a processing liquid.

In the case where the quantized data received by the receiving buffer 1001 has a value of level 1, 2, or 3, a proper pattern is selected from the plurality patterns assigned to the respective levels. It is desirable that a pattern be selected depending on the pattern used for the previous pixel so that the pixels to be inked are located at successive positions in a particular direction along as large a length as possible. The pattern selection is described in further detail below with reference to FIG. 16.

FIGS. 16A through 16G illustrate an example in which two adjacent pixels have the same level LEVEL1 as shown in FIG. 17A. The matrix patterns used herein are shown in FIG. 15.

If the pattern p12 is selected for the pixel located on the left side and the pattern p11 is selected for the adjacent pixel located on the right side as shown in FIG. 16B, then ink is applied to dots as shown in FIG. 16C. In this case, two inked dots are directly adjacent to each other. This results in a reduction in the number of inked dots located at edges, and thus the processing liquid is applied to only one dot as shown in FIG. 16D.

In contrast, if the pattern p12 is selected for the pixel located on the left side and the pattern p13 is selected for the adjacent pixel located on the right side, then ink is applied to dots as shown in FIG. 16F. Such a selection results in an increase in the number of inked dots located at edges, and thus the processing liquid is applied to two dots as shown in FIG. 15G. As can be understood from the above description, the amount of processing liquid consumed can be reduced by selecting patterns as shown in FIG. 16B.

FIG. 17 illustrates an example of selecting a proper pattern from the patterns p01–p41 depending on the previous pattern employed for the adjacent pixel. In the example shown in FIG. 17, a pattern is selected so that inked dots in the respective matrices are located at successive positions along as large a length as possible in the horizontal direction. In the case where any pattern cannot result in a succession of inked dots as is the case with the previous pixel having the pattern p11, it is desirable to select a pattern which causes the nozzles to be used evenly. When the image data has a quantized level of LEVEL0 or LEVEL4, there is only one possible pattern corresponding to each level and there is no other choice. Therefore, the patterns for LEVEL0 and LEVEL4 are not shown in FIG. 17.

The manner of selecting patterns is not limited to the above-described example, and selection may also be performed in different manners.

In the present embodiment, as described above, a pattern is selected not independently for each pixel but selected depending on the pattern selected for the previous pixel thereby ensuring that inked dots are located at successive locations along as large a length as possible across adjacent pixels thus achieving a reduction in the amount of processing liquid consumed while maintaining high resistance to water. In the case where any choice of pattern cannot result in a succession of inked dots across the adjacent pixels, a pattern which causes the nozzles to be used evenly is selected thereby preventing only a particular nozzle from being used very frequently compared to the other nozzles thus achieving an improvement in the life of the recording head.

Although in the present embodiment described above the pattern selection from the set of a plurality of matrix patterns is performed by the printer, the pattern selection may also be performed by a host computer (host apparatus) connected to the recording apparatus and responsible for generation of image data as in the second embodiment.

In this case, a plurality of matrix patterns corresponding to the respective levels of gray scale are stored in the pattern storage means in the printer, and the host computer selects a proper matrix pattern depending on the level of the gray level of the given image data and transmits data indicating the selected matrix pattern to the printer. For example, when image data corresponding to successive locations in a particular direction is given, the host computer selects matrix patterns on the basis of the image data so that inked dots in the respective matrix patterns corresponding to the image data are located at successive positions in the particular direction. In this case, when image data corresponding to successive locations in a particular direction is given, the host computer selects a matrix pattern for the image data at the current position depending on the matrix pattern employed for the image data at the previous locations, and generates data indicating the selected matrix pattern thereby ensuring that inked dots are located at successive positions in the particular direction thus achieving a reduction in the number of inked dots located at edges and a corresponding reduction in the amount of processing liquid consumed.

Other Embodiments

The processing liquid used in each embodiment described above to insolubilize the ink dye may be obtained for example as follows.

First, ingredients described below are mixed into a solution. The resultant solution is then filtered through a membrane filter with a pore size of 0.22 μm (phloropore filter available from Sumitomo Electric Industries., Ltd.) under application of pressure. If the filtered solution is adjusted in pH using NaOH, then a processing solution A1 is obtained.

Ingredients of A1 low molecular weight cation compound
stearyl trimethylammonium salt: 2.0 parts
(Elecrostripper QE available from Kao Corp.) or
stearyl trimethylammonium chloride
(Utamine 86P available from Kao Corp.)

high molecular weight cation compound copolymer of diarylamine hydrochloride and sulfur dioxide: 3.0 parts (mean molecular weight: 5000)

(polyaminesulfone PAS-92 available from Nitto Boseki Co., Ltd.)

thiodiglycol: 10 parts water: remaining part

A preferable ink which becomes insoluble when mixed with the processing liquid may be obtained for example as follows.

First, ingredients described below are mixed into a solution. If the resultant solution is filtered through a membrane filter with a pore size of 0.22 μm (phloropore filter available from Sumitomo Electric Industries., Ltd.) under application of pressure, inks Y1, M1, C1, and K1 with colors of yellow, magenta, cyan, and black are obtained.

Y1

C. I. direct yellow 142: 2 parts thiodiglycol: 10 parts acetylenol EH (available from Kawaken Fine Chemicals Co. Ltd.) 0.05 parts water: remaining part

M1

Ingredients are the same as those for Y1 except that the dye is replaced with 2.5 parts of C. I. acid red 289.

C1

Ingredients are the same as those for Y1 except that the dye is replaced with 2.5 parts of C. I. acid blue 9.

K1

Ingredients are the same as those for Y1 except that the dye is replaced with 2.3 parts of C. I. food black 2.

In the practical process, mixing between the processing liquid and the inks described above occurs in a state in which the processing liquid and the inks are on the surface or at the penetrated position of a recording medium. As a result, at a first stage of reaction, of the cations contained in the processing liquid, a low molecular weight component or a cation oligomer associates with a water-soluble dye including an anionic group contained in the ink by means of ionic interaction and the resultant associated substance is separated in an instant from the solution phase.

At a second stage of the reaction, the associated substance formed from the dye and the low molecular weight cation or cation oligomer is adsorbed by the high molecular weight components contained in the processing liquid, and the size of the aggregate of the dye becomes further greater. This makes it difficult for the aggregate to penetrate into fibers of the recording medium. As a result, only the solution part separated from the solid part penetrates into the recording paper, and thus good print quality and good fixing characteristic are achieved. The aggregated substance formed via the above process from the anionic dye and the low molecular weight cation or the cationic oligomer has a high viscosity. Therefore, it does not move when the solution part moves. This prevents the dye from being mixed between adjacent dots. Therefore, even if adjacent dots are formed with inks with different colors, mixing between inks does not occur and thus bleeding is prevented. The aggregated substance is insoluble in water and thus the image formed has an extremely high resistance to water. Furthermore, the light-fastness of the image is improved by the shielding property of the polymer.

In this invention, "becoming insoluble" and "aggregation" can occur either at only the first stage or at both first and second stages.

As for the ink emission part and the processing liquid emission part of the recording head, it is particularly desirable to employ an emission part of the type including a thermal energy generation element such as an electrothermal conversion element used to generate thermal energy thereby inducing a change in state of the ink or processing liquid and thus emitting the ink or the processing liquid, although it is also possible to employ another type of recording head such as that having a piezoelectric element.

In the present invention, as described above, when received data with a low resolution is converted to data with a high resolution using a dot matrix, patterns are selected so that inked dots are arranged at successive locations along as large a length as possible in a particular direction thereby preventing an excessive application of the processing liquid thus achieving a high-quality image including no distortion due to absorption of water into paper and a reduction in the running cost.

What is claimed is:

1. An ink-jet recording apparatus for recording on a recording medium using an ink emission part for emitting an ink and a liquid emission part for emitting a liquid which acts on an ink when it comes into contact with the ink, said ink-jet recording apparatus comprising:

recording control means for controlling the operation of said ink emission part so that recording is performed by said ink emission part using a matrix pattern representing which pixel of a matrix is to be inked, said matrix consisting of a plurality of pixels located at L (integer equal to or greater than 2)×M (integer equal to or greater than 2) array positions wherein if said matrix pattern includes a plurality of pixels to be inked, said plurality of pixels to be inked are located at successive array positions in a predetermined direction; and liquid emission control means for controlling the operation of said liquid emission part so that the liquid is emitted from the liquid emission part toward a particular pixel of said plurality of pixels to be inked located at successive pixel positions in the predetermined direction, said particular pixel being located at a transitional boundary from a pixel not to be inked to a pixel to be inked.

2. An ink-jet recording apparatus according to claim 1, wherein said liquid emission control means controls the operation of said liquid emission part so that said liquid emission part emits the liquid to every predetermined number of pixels of said plurality of pixels to be inked located at successive pixel positions in the predetermined direction.

3. An ink-jet recording apparatus according to claim 1, wherein said recording control means uses such matrix patterns which result in a succession of inked dots across adjacent recording areas.

4. An ink-jet recording apparatus according to claim 1, wherein said liquid includes a component that makes a coloring component of an ink insoluble or aggregated.

5. An ink-jet recording apparatus according to claim 1, wherein said ink emission p art includes a plurality of sets of emission orifices, said plurality of sets corresponding to a plurality of inks with different colors, respectively.

6. An ink-jet recording apparatus according to claim 1, wherein said ink emission part includes a plurality of sets of emission orifices, said plurality of sets of emission orifices including a plurality of sets of emission orifices corresponding to a plurality of inks which are similar in color but different in density.

7. An ink-jet recording apparatus according to claim 1, wherein at least one of said ink emission part and said liquid emission part includes an energy generation element for applying an energy to the ink and liquid so as to emit the ink and liquid.

8. An ink-jet recording method for recording by applying an ink and a liquid to a recording medium, said ink containing a dye, said liquid having the capability of acting on said ink when said liquid comes into contact with the ink, said method comprising the steps of:

applying the ink to the recording medium using a matrix pattern representing which pixel of a matrix is to be inked, said matrix consisting of a plurality of pixels located at L (integer equal to or greater than 2)×M (integer equal to or greater than 2) array positions wherein if said matrix pattern includes a plurality of pixels to be inked, said plurality of pixels to be inked are located at successive array positions in a predetermined direction; and emitting the liquid to a particular pixel of said plurality of pixels to be inked located at successive pixel positions in the predetermined direction, said particular pixel being located at a transitional boundary from a pixel not to be inked to a pixel to be inked.

9. An image processing apparatus for processing input image data so as to generate data used by an ink-jet recording apparatus for recording on a recording medium using an ink emission part for emitting an ink and a liquid emission part for emitting a liquid which acts on an ink when it comes into contact with the ink, said image processing apparatus comprising:

ink emission data output means for outputting, to said ink-jet recording apparatus, ink emission data according to which said ink emission part performs recording by using a matrix pattern representing which pixel of a matrix is to be inked, said matrix consisting of a plurality of pixels located at L (integer equal to or greater than 2)×M (integer equal to or greater than 2) array positions wherein if said matrix pattern includes a plurality of pixels to be inked, said plurality of pixels to be inked are located at successive array positions in a predetermined direction; and liquid emission data output means for outputting liquid emission data, to said ink-jet recording apparatus, according to which said liquid emission part emits the liquid to a particular pixel of said plurality of pixels to be inked located at successive pixel positions in the predetermined direction, said particular pixel being located at a transitional boundary from a pixel not to be inked to a pixel to be inked.

10. An ink-jet recording apparatus for recording on a recording medium using an ink emission part for emitting an ink and a liquid emission part for emitting a liquid which acts on an ink when it comes into contact with the ink, said ink-jet recording apparatus comprising:

a receiving unit for receiving transmitted image data, said image data representing an n-level gray scale where n is an integer equal to or greater than 3;

pattern storage means for storing a plurality of matrix patterns corresponding to the respective levels of the gray scale, said matrix patterns each representing a particular pixel at which a dot is formed in a matrix consisting of a plurality of pixels located at L (integer equal to or greater than 2)×M (integer equal to or greater than 2) array positions, wherein if any matrix pattern corresponding to a particular level of the gray scale includes a plurality of pixels to be inked, said plurality of pixels to be inked are located at successive array positions in a predetermined direction; and recording control means for generating ink emission data representing which pixel is to be inked, said ink emission data being generated by converting the image data received via said receiving unit to a matrix pattern selected from the matrix patterns stored in said pattern storage means depending on the level of the gray scale indicated by the image data, further determining, on the basis of said ink emission data, the pixel location to which the liquid is emitted, and then emitting the ink from said ink emission part in accordance with said ink emission data and also emitting the liquid from said liquid emission part thereby recording an image corresponding to said image data on the recording medium.

11. An ink-jet recording apparatus according to claim 10, wherein the pixel location to which the liquid is emitted is determined on the basis of the location of a particular pixel of the pixels which are inked according to the ink emission data, said particular pixel being detected at an edge of the pixels.

12. An ink-jet recording apparatus according to claim 10, wherein the pixel positions to which the liquid is emitted include a pixel position at an edge of the pixels to be inked in accordance with said ink emission data and also include pixel positions other than said edge position taken every predetermined number of pixel positions from the pixels to be inked in accordance with said ink emission data.

13. An ink-jet recording apparatus according to claim 10, wherein said pattern storage means stores a plurality of matrix patterns assigned to at least a particular level of the gray scale, so that pixels to be inked are located at different positions in the matrix.

14. An ink-jet recording apparatus according to claim 13, wherein said pattern storage means stores one matrix pattern assigned to the highest level of the gray scale and one matrix pattern assigned to the lowest level of the gray scale.

15. An ink-jet recording apparatus according to claim 13, wherein said recording control means generates ink emission data by selecting matrix patterns corresponding to the image data so that if the image data correspond to successive locations in a particular direction, the pixels to be inked in the selected matrix patterns are located at successive positions in the particular direction.

16. An ink-jet recording apparatus according to claim 13, wherein said recording control means generates ink emission data by selecting matrix patterns corresponding to the image data so that if the image data correspond to successive locations in a particular direction, the matrix pattern for the image data at the current position is determined depending on the matrix pattern for the image data at the previous position.

17. An ink-jet recording apparatus according to claim 10, wherein said liquid includes a component that makes a coloring component of an ink insoluble or aggregated.

18. An ink-jet recording apparatus according to claim 10, wherein at least one of said ink emission part and said liquid emission part includes an energy generation element for applying an energy to the ink and liquid so as to emit the ink and liquid.

19. A recording method of recording on a recording medium using an ink-jet recording apparatus, said recording being performed using an ink emission part for emitting an ink and a liquid emission part for emitting a liquid which acts on an ink when it comes into contact with the ink, said method comprising the steps of:

receiving transmitted image data, said image data representing an n-level gray scale where n is an integer equal to or greater than 3;

generating ink emission data representing which pixel is to be inked, in accordance with a matrix pattern corresponding to the level of the gray scale indicated by the received image data, said matrix pattern representing a particular pixel at which a dot is formed in a matrix consisting of a plurality of pixels located at L (integer equal to or greater than 2)×M (integer equal to or greater than 2) array positions, wherein if the matrix pattern corresponding to a particular level of the gray scale includes a plurality of pixels to be inked, said plurality of pixels to be inked are located at successive array positions in a predetermined direction;

determining, on the basis of said ink emission data, the pixel location to which the liquid is emitted, and emitting the ink from said ink emission part in accordance with said ink emission data and also emitting the liquid from said liquid emission part thereby recording an image corresponding to said image data on the recording medium.

20. A recording method according to claim 19, wherein the pixel location to which the liquid is emitted is determined on the basis of the location of a particular pixel of the pixels which are inked according to the ink emission data, said particular pixel being detected at a pixel edge.

21. A recording method according to claim 19, wherein the pixel positions to which the liquid is emitted include a pixel position at an edge of the pixels to be inked in accordance with said ink emission data and also include pixel positions other than said edge position taken every predetermined number of pixel positions from the pixels to be inked in accordance with said ink emission data.

22. A recording method according to claim 19, wherein a plurality of matrix patterns are assigned to at least a particular level of the gray scale, so that pixels to be inked are located at different positions in the matrix.

23. A recording method according to claim 22, wherein one matrix pattern is assigned to the highest level of the gray scale and one matrix pattern is assigned to the lowest level of the gray scale.

24. A recording method according to claim 22, wherein said ink emission data generation step generates ink emission data by selecting matrix patterns corresponding to the image data so that if the image data correspond to successive locations in a particular direction, the pixels to be inked in the selected matrix patterns are located at successive positions in the particular direction.

25. A recording method according to claim 22, wherein said ink emission data generation step generates ink emission data by selecting matrix patterns corresponding to the image data so that if the image data correspond to successive locations in a particular direction, the matrix pattern for the image data at the current position is determined depending on the matrix pattern for the image data at the previous position.

26. A recording method according to claim 19, wherein said liquid includes a component that makes a coloring component of an ink insoluble or aggregated.

27. A recording method according to claim 19, wherein at least one of said ink emission part and said liquid emission part includes an energy generation element for applying an energy to the ink and liquid so as to emit the ink and liquid.

28. A method of outputting data to an ink-jet recording apparatus from a host apparatus connected to said recording apparatus, said ink-jet recording apparatus generating ink emission data representing which pixel is to be inked in accordance with a matrix pattern corresponding to the level of gray scale using an ink emission part for emitting an ink and a liquid emission part for emitting a liquid which acts on the ink when it comes into contact with the ink, and further determining, on the basis of said ink emission data, the pixel position to which the liquid is emitted, and then emitting the ink and liquid thereby recording an image corresponding to said image data on a recording medium, said method comprising the steps of:

generating image data representing an n-level gray scale in accordance with an image to be recorded;

generating pattern designation data in accordance with the generated image data, said pattern designation data designating a matrix pattern corresponding to a particular level of the gray scale of the image data, said matrix patterns each representing a particular pixel at which a dot is formed in a matrix consisting of a plurality of pixels located at L (integer equal to or greater than 2)×M (integer equal to or greater than 2) array positions, wherein if any matrix pattern corresponding to a particular level of the gray scale includes a plurality of pixels to be inked, said plurality of pixels to be inked are located at successive array positions in a predetermined direction; and outputting said data designating the matrix pattern to the ink-jet recording apparatus connected to the host apparatus.

29. A method according to claim 28, wherein:

the matrix patterns designated by the pattern designation data include a plurality of matrix patterns which are assigned to at least a particular level of the gray scale so that pixels to be inked are located at different positions in the matrix; and said pattern designation data generation step generates data designating matrix patterns corresponding to the image data so that if the image data correspond to successive locations in a particular direction, the pixels to be inked in the selected matrix patterns are located at successive positions in the particular direction.

30. A method according to claim 28, wherein:

the matrix patterns designated by the pattern designation data include a plurality of matrix patterns which are assigned to at least a particular level of the gray scale so that pixels to be inked are located at different positions in the matrix; and said ink emission data generation step generates data designating matrix patterns by selecting matrix patterns corresponding to the image data so that if the image data correspond to successive locations in a particular direction, the matrix pattern for the image data at the current position is determined depending on the matrix pattern for the image data at the previous position.

* * * * *

UNITED STATES PATENT AND TRADEMARK OFFICE

CERTIFICATE OF CORRECTION

PATENT NO. : 6,158,834
DATED : December 12, 2000
INVENTOR(S) : KATO ET AL.

It is certified that error appears in the above-identified patent and that said Letters Patent is hereby corrected as shown below:

COLUMN 1:
Line 50, "and." should read --and--.

COLUMN 2:
Line 62, "pixels" (first occurrence) should read --pixel--.

COLUMN 3:
Line 60, "pattern." should read --pattern--.

COLUMN 6:
Line 17, "diagram" should read --diagrams--.
Line 56, "diagrams" should read --schematic diagrams--.

COLUMN 17:
Line 11, "p art" should read --part--.

Signed and Sealed this

Fifth Day of June, 2001

Nicholas P. Godici

NICHOLAS P. GODICI

*Acting Director of the United States Patent and Trademark Office*

*Attest:*

*Attesting Officer*